US009416941B2

(12) United States Patent
Mii

(10) Patent No.: US 9,416,941 B2
(45) Date of Patent: Aug. 16, 2016

(54) LIGHT-EXTRACTION APPARATUS FOR AN OPTICAL-FILM LIGHTING SET HAVING A VISIBLE-LIGHT COATING

(76) Inventor: Jenn-Wei Mii, Taipei (TW)

( * ) Notice: Subject to any disclaimer, the term of this patent is extended or adjusted under 35 U.S.C. 154(b) by 287 days.

(21) Appl. No.: 14/113,634

(22) PCT Filed: Apr. 27, 2012

(86) PCT No.: PCT/CN2012/000565

§ 371 (c)(1),
(2), (4) Date: Jan. 24, 2014

(87) PCT Pub. No.: WO2012/146064

PCT Pub. Date: Nov. 1, 2012

(65) Prior Publication Data

US 2014/0153230 A1 Jun. 5, 2014

(30) Foreign Application Priority Data

Apr. 27, 2011 (CN) ..... 2011 2 0128262 U

(51) Int. Cl.

| | |
|---|---|
| ***F21V 9/16*** | (2006.01) |
| ***H01J 61/35*** | (2006.01) |
| ***H01J 61/02*** | (2006.01) |
| ***H01J 61/33*** | (2006.01) |

(52) U.S. Cl.

CPC ..... *F21V 9/16* (2013.01); *H01J 61/025* (2013.01); *H01J 61/33* (2013.01); *H01J 61/35* (2013.01); *H01J 2261/385* (2013.01)

(58) Field of Classification Search

CPC ..... F21V 9/16; H01J 61/35
See application file for complete search history.

(56) References Cited

U.S. PATENT DOCUMENTS

| | | | | |
|---|---|---|---|---|
| 5,798,608 | A * | 8/1998 | Shaw | H01J 61/42 313/485 |
| 6,528,938 | B1 * | 3/2003 | Jansma | H01J 61/46 313/485 |
| 2005/0073240 | A1 * | 4/2005 | Mayer | C01F 7/02 313/489 |
| 2005/0242702 | A1 * | 11/2005 | Justel | H01J 61/42 313/489 |
| 2008/0224068 | A1 * | 9/2008 | Mii | H01J 61/305 250/461.1 |

* cited by examiner

*Primary Examiner* — Elmito Breval
(74) *Attorney, Agent, or Firm* — WPAT, PC; Justin King; Douglas Hosack

(57) ABSTRACT

A light-extraction apparatus for an optical-film lighting set having a visible-light coating include a transparent sealed body, a wide AOR (0 degree to 90 degrees) optical film for reflecting ultraviolet lights and a visible light layer. The transparent sealed body is formed as a hollow shell body to accommodate an ultraviolet light source. A supporting member coated with the optical film and the visible light layer is constructed to a wall of the shell body or inside the shell body. The visible light layer is consisted of monolayered fluorescent or phosphorescent particles, and the particles are evenly distributed to coat on the interior wall of the shell body or the supporting member inside the shell body in a sparse scattering manner. A fixed area ratio of the coverage of the particles to that of the inter-particle spacing is then provided to the visible light layer for obtaining a higher illumination performance.

59 Claims, 25 Drawing Sheets

LIGHT-EXTRACTION APPARATUS FOR AN OPTICAL-FILM LIGHTING SET HAVING A VISIBLE-LIGHT COATING

BACKGROUND OF INVENTION

1. Field of the Invention

The invention relates to an improved gas discharge lamp with an interior optical-lighting film, in which a visible-light coating thereof is characterized in a specific distributed density.

2. Description of the Prior Art

In current art of the light-emitting elements, the typical structure therefore includes a transparent glass tube having an interior wall coated by a fluorescent or phosphorescent layer with a predetermined width, in which the fluorescent or phosphorescent layer is consisted of piling particles. Inside the transparent tube, an electroluminescence photo gas such as the Mercury gas, the Argon gas, the Xenon gas, the Neon gas and son on is filled. As the tube is electrically energized, the internal photo gas would be charged by the high electric potential to emit the corresponding ultraviolet light to illuminate the fluorescent or phosphorescent layer so as to have the tube to emit the visible light. The visible light then penetrates the fluorescent or phosphorescent layer as well as the transparent casing so as to perform as a lamp set.

For the aforesaid fluorescent or phosphorescent layer is formed by piling a plurality of tiny particles, in order to have the fluorescent or phosphorescent layer to absorb enough ultraviolet energy at a single projection, it is inevitable to increase the thickness of the fluorescent or phosphorescent layer, i.e. to increase the piling of the tiny particles. However, a disadvantage from increasing the thickness of the fluorescent or phosphorescent layer is to decrease the penetration rate of the visible lights. It is noted that, for the visible lights, the fluorescent or phosphorescent layer reduce the transparency of the tube. Hence, for the skill person in the art, a preferred thickness of the fluorescent or phosphorescent layer based on an acceptable penetration rate of the visible light is determined by firstly choosing a fixed ultraviolet light source, then adjusting the thickness of the fluorescent or phosphorescent layer, and finally determining the thickness of the fluorescent or phosphorescent layer by evaluating the corresponding illuminus of the tube. In practice, a thinner layer of piled particles implies that some of the ultraviolet energy is lost or wasted because of fewer particles in the piling being unable to absorb completely the projected ultraviolet energy. However, even in such a circumstance, the accumulated piling number of the particles in the fluorescent or phosphorescent layer is summed up to 4 or 5 layers at least and 7 or 8 layers at most (referred to FIG. 18). Definitely, such a particle piling does also form a substantial obstacle to the visible lights.

Referring now to FIG. 37, a top view of a typical visible light layer under a scanning electron microscopy (SEM) is shown, in which a solid arrangement of particles in the visible light layer is clearly observed.

In practice, the fluorescent or phosphorescent layer coated inside the light-emitting element would face directly the internal electric-energized ultraviolet light and thus would be the most illuminated area there around. However, for the visible light produced by energizing the fluorescent or phosphorescent layer, the thickness of the fluorescent or phosphorescent layer is inevitably performed as an obstacle wall against the penetration of the visible light. Therefore, upon the aforesaid arrangement, the illumination efficiency of the light tube is definitely low. It is straightly forward that a thinner fluorescent or phosphorescent layer is expected to increase the light penetration rate of the visible lights, but yet such a change would lead to a low absorption rate of the source ultraviolet lights. In the art, it is hard to locate an optimal pair of the penetration rate of the fluorescent or phosphorescent layer and the absorption rate of the ultraviolet lights. Namely, in the art, with the premise of not to waste the source ultraviolet lights, it is almost impossible to achieve a satisfied illumination by forming the fluorescent or phosphorescent layer in a mono-layered scattering pattern. Yet, it is the primary object of the present invention to locate an efficiency solution that can make thinner the fluorescent or phosphorescent layer without sacrificing the cost in the ultraviolet energy. Also, thereby the energy can be reserved and the exhaustion of $CO_2$ can be reduced to an acceptable degree.

Further, referring now to FIG. 16 and FIG. 17, a conventional design of an optical-film light tube is shown in a perspective view and a cross sectional view, respectively. As shown, the wall of the transparent tube 70 is coated by a fluorescent or phosphorescent layer as the visible light layer 71. Particles or powders of the visible light layer 71 are arranged in a form of multiple-layered piling and with a piling thickness (C) of about 30 μm to 60 μm (or 30 μm in average). Upon such an arrangement in the visible light layer 71, while the ultraviolet light 40 hits the particle to emit another light (the visible light), it is easy to see that only the surface particles on the fluorescent or phosphorescent layer 71 can be bombarded heavily by the ultraviolet lights. During the process, the particles distant to the surface of the visible layer 71 can contribute a pretty minor function in emitting the visible lights. Namely, the cost in building the distant portion of the visible layer 71 is wasted. Definitely, it is a topic worth to be resolved.

In addition, in the art of stimulating the short wave lights to produce the long wave lights at the visible light layer, conventional light-emitting elements such as the white LED, the discharge light tube (i.e., the hot cathode fluorescent lamp, HCFL), the cold cathode fluorescent lamp (CCFL), the induction lamp and the tiny discharge cell (applied to a plasma panel) are usually seen. The white LED is to project the ultraviolet lights onto the fluorescent or phosphorescent powders so as to emit white lights, or to project the blue lights onto the fluorescent or phosphorescent powders so as to emit corresponding yellow (red or green) lights for producing white lights after mixing the original penetrating blue lights. In general, the white light is consisted of 30% red light, 59% green light and 11% blue light.

Further, either the low-voltage mercury electric-discharge lamp or the electrodeless lamp is basically structured by a transparent glass tube having an interior fluorescent or phosphorescent coating with a predetermined thickness as the visible light layer. The average diameter of the tiny fluorescent or phosphorescent particles is about 2 μm to 20 μm, and the piling thickness is about 10 μm to 50 μm, or even up to about 100 μm. The transparent glass tube is filled thereinside by an electroluminescence (EL) mercury gas. Upon meeting an across voltage, the internal gas would be energized by an induced high voltage field or an induced magnetic field to emit ultraviolet lights. Then, the ultraviolet lights project on the fluorescent or phosphorescent layer so as to induce corresponding visible lights. The visible lights further penetrate the fluorescent or phosphorescent layer and leave the transparent glass tube to the outside. Upon such an arrangement, the aforesaid transparent glass tube having an interior fluorescent or phosphorescent coating can then perform as a light source. Nevertheless, some problems as described below do exist in the applications of the aforesaid low-voltage mercury electric-discharge lamp and the LED tube that uses the ultraviolet lights to generate the white lights.

On of the problems is the low yield of the ultraviolet lights. Because the fluorescent or phosphorescent layer is accumulated by plural tiny particles, and in order to obtain a sufficient amount of energy upon a single projection of the ultraviolet lights, the fluorescent or phosphorescent layer shall have a substantial thickness. However, a large thickness in the fluorescent or phosphorescent layer would affect the penetration rate of the induced visible lights definitely. In the current art, in order to obtain a better shining performance, the manufacturer usually reduces the thickness of the fluorescent or phosphorescent layer for the light tube. However, such a thin layer in the fluorescent or phosphorescent layer implies that a substantial amount of spacings with respect to the ultraviolet lights exists between the accumulated particles. Thus, some of the ultraviolet lights might not project on the particles but directly on the wall of the tube, such that the ultraviolet lights projecting on the wall would be absorbed by the wall and then be transformed into corresponding heat energy. Such a portion of the energy as the heat energy is then wasted in view of illumination purpose. It is interesting in the practice that a wide-acceptable criterion for coating the visible light layer is to have the ultraviolet lights with a predetermined strength to pair a visible light layer with a predetermined thickness. Namely, a stronger ultraviolet light is to pair a thicker visible light layer so as to obtain sufficient light absorption in the visible light layer upon a single projection of the ultraviolet light. However, under such a circumstance, the corresponding penetration rate of the visible lights in the fluorescent or phosphorescent layer would be reduced and thus the yield of the ultraviolet lights is definitely reduced as well. In a prior design of the optical-film lamp tube by the inventor himself as shown in FIG. 16 and FIG. 17, the yield of the ultraviolet lights is hiked up to 99.5%. It seems that the aforesaid ill-yield problem has been resolved by the prior design, but at least two following further problems are yet to be answered.

Problem I: Ill Penetration Rate Caused by Over Thickness in Visible Light Area

In the art, the fluorescent or phosphorescent particle is not instinctive transparent, and so the fluorescent or phosphorescent layer formed by piling the fluorescent or phosphorescent particles is consequently not transparent to the visible lights. An easy way to verify this argument is to fetch a T8 tube in the marketplace, place it without any voltage crossing between a naked eye and a visible light source, and demonstrate the truth that the visible lights of the visible light source are greatly blocked by the tube. Such a phenomenon is because that the visible lights must penetrate the poor-transparent tube (with the fluorescent or phosphorescent particles coated) before they can achieve the naked eye. In this experiment, for the fluorescent or phosphorescent layer in the tube is formed poor-transparently, so the naked eye can't see too much light from the visible light source. For a typical T8 tube in the marketplace, its monolayered fluorescent layer may reduce the penetration rate by about 40%. Such a reduction in the penetration rate is transformed into heat energy of the tube. In general, the average thickness of the piling particles (including at least 4-5 laminates of the particles) in the fluorescent area of the aforesaid tube is about 10 μm to 30 μm. Referring now to FIG. 18, an SEM view of a preferred tube in the market place is shown, in which the average diameter for the piling particles is about 3 μm, and the average piling thickness is about 15 μm. Please note that, even with such a thickness, the visible light layer still plays the major role to reduce the tube's brightness. Typically, the brightness of the tube would be reduced to 70% by this fluorescent layer.

Problem II: Blocking of Visible Lights by Crowd-Arranged Fluorescent or Phosphorescent Particles It is comprehensive that a tight arrangement of the fluorescent or phosphorescent particles would affect the penetration of the visible lights. Even in the case that the visible light layer is consisted of a single layer of the fluorescent or phosphorescent particles, the crowding situation among particles would still reduce the penetration rate of the visible lights induced by having the ultraviolet lights to project on the fluorescent or phosphorescent particles. In general, only the induced visible lights that are limited to the ±15-degree area about the vertical normal line of the individual particle can be free to penetrate the visible light layer, and the rest of the induced visible lights would hit the neighboring particles at their travelling journals. In particular, the induced visible lights traveling inside the ±45-degree area about the horizontal normal light of the corresponding particle are definitely to be deflected by the neighboring particles, and thus the brightness contributed by the instant particle is substantially reduced. It got to be emphasized that, even with the involvement of the 0~90-degree wide AOR ultraviolet optical film, spacing between crowd particles of the mono-layered fluorescent or phosphorescent layer is still large in an optical view. Thus, plenty of ultraviolet energy would be wasted as a form of heat to dissipate. Therefore, in a traditional design, at least four to five layers of particles are laminated so as to minimize the influence of inter-particle spacing and so as to obtain a better absorption of the ultraviolet radiations. Hence, it is easy to understand that in the art the fluorescent or phosphorescent layer with single-layered particles is commercially infeasible for the sake of energy conservations. This is the reason why no light tube using an ultraviolet source and applying only mono-layered particles can be seen in the marketplace.

The aforesaid discussion in the energy view for the traditional light tube prevails as well for the ultraviolet LED tube that introduces a blue light to project on the fluorescent or phosphorescent particles so as to induce the corresponding white light. Basically, in the art, the control variables are the inter-particle spacing of the fluorescent or phosphorescent layer and the capacity of the blue-light source. By providing over-rated blue lights to penetrate the fluorescent or phosphorescent particles that emit the yellow lights, the white light can be obtained by mixing the blue lights and the yellow or red-green lights induced by projecting the blue light on the fluorescent or phosphorescent layer. In the aforesaid discussion, the thickness or the inter-particle spacing of the fluorescent or phosphorescent layer must be predetermined, such that 11% of the blue lights can penetrate through the coating so as to become a part of the white light. Obviously, for a better white light mixing, the aforesaid thickness can't be made thinner, and also the inter-particle spacing can't be made larger to increase the transparency of the fluorescent or phosphorescent layer.

It is always a hope in the art that a preferred white light can be still formed by a mono-layered fluorescent or phosphorescent coating and also by a coating consisted of sparse scattering particles that are able to provide sufficient spacing. Then, the corresponding brightness for the light tube can be definitely and greatly improved.

SUMMARY OF THE INVENTION

Accordingly, it is the primary object of the present invention to provide an light-extraction apparatus for an optical-film lighting set having a visible-light coating, in which a predetermined mono-layered scattering pattern of particles is applied to the visible light layer of a light tube, by which the ultraviolet light, projecting on or not on the particle of the visible layer, can reflect at least once before it hits the particle. Upon such an arrangement, the usage of the visible light layer can be greatly reduced, and both the aforesaid Problem I and Problem II can be successfully resolved.

In order to achieve the aforesaid objects, in one aspect of the present invention, the light-extraction apparatus for an optical-film lighting set having a visible-light coating includes a transparent sealed shell, an optical film able to omnidirectionally reflect ultraviolet lights for an angle of incidence ranged from 0 to 90 degrees but to allow visible lights to penetrate therethrough, and a visible light layer. The transparent sealed shell is formed as a hollow pipe structure, and the optical film and the visible light layer are both coated onto a wall of the hollow pipe structure. The visible light layer is consisted of fluorescent particles or phosphorescent particles, and the aforesaid particles are sparsely adhered to the wall in a predetermined distributed density.

In one embodiment of the present invention, the wall of the hollow pipe structure further has an exterior wall coated with the optical film and an interior wall opposing to the exterior wall and coated with the visible light layer.

In one embodiment of the present invention, the wall of the hollow pipe structure further has an exterior wall and an interior wall opposing to the exterior wall, in which the interior wall is laminated by the optical film and the visible light layer.

In one embodiment of the present invention, an interior wall of the hollow pipe structure is coated by a monolayer of the fluorescent particles or the phosphorescent particles.

In one embodiment of the present invention, the wall of the hollow pipe structure includes a coated area (A) coated by the visible light layer, and the rest of the wall other than the coated area (A) is defined as an uncoated area (B), in which the coated area (A) occupies 1%~99% in area of the wall.

In one embodiment of the present invention, the interior wall of the hollow pipe structure includes a coated area (A) coated by the visible light layer, and the rest of the interior wall other than the coated area (A) is defined as an uncoated area (B), in which the coated area (A) occupies 1%~99% in area of the interior wall.

In one embodiment of the present invention, the particles in the visible light layer are coated in a scattering manner.

In one embodiment of the present invention, the particles in the scattering manner are arranged in a form of monolayer coating and have granular sizes ranged from 2 μm to 15 μm.

In one embodiment of the present invention, 1%~99% of a total area of the coated area (A) is an integrated area (X) of the granular coverage (A2) of the particles of the visible light layer, and the rest (Y) of the total area is contributed by integrating areas for inter-particle spacings (A1).

In another aspect of the present invention, the light-extraction apparatus for an optical-film lighting set having a visible-light coating includes a transparent sealed shell, a transparent sealed casing, an optical film, a visible light layer and a supporting member. The transparent sealed casing is formed as a hollow structure. The optical film omnidirectionally reflects ultraviolet lights for an angle of reflection ranged from 0 to 90 degrees but to allow visible lights to penetrate therethrough. The optical film is coated onto either an exterior wall or an interior wall of the transparent sealed shell. The supporting member installed inside the transparent sealed shell is coated by the visible light layer. The visible light layer is consisted of fluorescent particles or phosphorescent particles, and the aforesaid particles are sparsely coated onto the supporting member in a predetermined distributed density.

In one embodiment of the present invention, the visible light layer on the supporting member includes a single layer (i.e. monolayer) of the fluorescent particles or the phosphorescent particles.

In one embodiment of the present invention, a wall of the supporting member for coating the visible light layer includes a coated area (A) coated by the visible light layer and the rest of the wall other than the coated area (A) is defined as an uncoated area (B), in which the coated area (A) occupies 1%~99% in area of the wall.

In a further aspect of the present invention, the light-extraction apparatus for an optical-film lighting set having a visible-light coating includes a transparent sealed shell, a transparent sealed casing, an optical film and a visible light layer. The transparent sealed casing is formed as a hollow structure. The optical film omnidirectionally reflects ultraviolet lights for an angle of reflection ranged from 0 to 90 degrees but to allow visible lights to penetrate therethrough. The transparent sealed casing is formed as an ultraviolet light generator for generating outgoing ultraviolet lights inside the transparent sealed shell. The transparent sealed shell further has an interior wall and an opposing exterior wall. The optical film is coated to either the exterior wall or the interior wall thereof. The visible light layer is coated to the interior wall. The visible light layer is consisted of fluorescent particles or phosphorescent particles, and the aforesaid particles are sparsely coated onto the interior wall in a scattering manner.

In one embodiment of the present invention, both the optical film and the visible light layer are coated onto the interior wall of the transparent sealed shell, in an arrangement of locating the visible light layer closer to the transparent sealed casing forming the ultraviolet light generator over the optical film.

In one embodiment of the present invention, the visible light layer is formed as one of a single-particle-layered fluorescent or phosphorescent coating.

In one more aspect of the present invention, the light-extraction apparatus for an optical-film lighting set having a visible-light coating includes a transparent sealed shell, a transparent sealed casing, an optical film and a visible light layer. The transparent sealed casing is formed as a hollow structure. The optical film omnidirectionally reflects ultraviolet lights for an angle of reflection ranged from 0 to 90 degrees but to allow visible lights to penetrate therethrough. The transparent sealed casing is an ultraviolet light generator for generating outgoing ultraviolet lights inside the transparent sealed shell. The transparent sealed shell further has an interior wall and an opposing exterior wall. The optical film is coated to either the exterior wall or the interior wall thereof. The visible light layer is coated onto a supporting member inside the transparent sealed shell. The visible light layer is consisted of fluorescent particles or phosphorescent particles, and the aforesaid particles are sparsely coated on the supporting member in a scattering manner.

In one embodiment of the present invention, the supporting member inside the transparent sealed shell is coated by the visible light layer, in which the visible light layer is formed as one of a single-particle-layered fluorescent or phosphorescent coating.

In one embodiment of the present invention, the supporting member inside the transparent sealed shell is coated by the visible light layer, in which the a surface of supporting member includes a coated area (A) coated by said visible light layer and the rest of the surface other than the coated area (A) is defined as an uncoated area (B), wherein the coated area (A) occupies 1%~99% of the surface.

By providing the present invention, the coating of the visible light layer on the wall of the light tube of the optical-film lighting set is sparsely scattering and evenly distributed so as to reduce greatly the shortcoming of the induced visible light being blocking by the fluorescent or phosphorescent particles, and thus so as to enhance efficiently the illumination performance. Upon increasing the illumination performance by thoroughly reacting the scattered particles with the ultraviolet lights, the cost in forming the visible light layer (mainly for the thickness thereof) can be substantially reduced.

It is a further object of the present invention to provide the light-extraction apparatus for an optical-film lighting set having a visible-light coating, which can improve the prior shortcoming in the coated area of the visible light layer. In this improvement, the present invention firstly divides the current visible light layer into a coated area and an uncoated area, as shown in FIG. 2. In the coated area, the fluorescent or phosphorescent particles in the coated area is sparsely scattered, i.e. in a manner of rarefaction coating or sparse coating), such that the particle pile or the single particle layer can present more spacing between particles. Therefore, in the vertical projection of the coated area upon the coating surface, the coated block or any surface in the coated block, the projected area of the particle pile and the single particle (Aps) and the total projection area (Av) of the vacant space (v) are kept in a fixed sparse distributed ratio (1), which is R1(uv)=Aps/(Aps+Av)=5%~95% for the ultraviolet light application and R1(bu)=Aps/(Aps+Av)=5%~85% for the blue light application. Both of the aforesaid two ratios are called as the sparse excited coating of visible light. In the foregoing description, the single particle stands for the isolated particle in the coating, and the particle pile is for a local solid piling including at least two particles. The fixed sparse distributed ratio (1-1) for the very even and also sparse excited coating of visible light among the particle piles and the single particles is defined to keep a fixed distance between any two neighboring particle piles, between any two neighboring single particles, or between any two neighboring particle pile and the single particle. The sparse coating for forming the visible light is positive to further reduce the number of the particle piles in the visible light layer.

In the coated area of the visible light layer including the surface consisted of the particle piles p and the individual single particles s crowded together or the surface in the coated block, the thinnest single particle excited coating layer of visible light (2) is defined by a fixed ratio R2=As/(Ap+As+Av), in which 2%≤R2≤98%, the As is the total vertical projection surface of the particle piles p and the single particles s in the coated area with respect to the coated surface, and the Av is the total projection surface of the spacings Av.

By introducing the sparse scattering coating to the thinnest single particle excited coating layer of the visible light, a larger spacing v would be generated between the single particle and another single particle. In the coated area of the visible light layer including the coating surface and the surface in the coated block, the single particle thinnest and sparsest excited coating layer of visible light (3) is defined by a fixed sparse ratio R3=As/(As+Av)=15%~85%, in which the As is the total projection area of the single particles, the Av is the total projection area by summarizing the As and the total projection area of the spacings v.

Further, the very even single particle and also thinnest and sparsest excited coating layer of visible light (3-1) are defined by further distributing the single particles so as to keep a fixed sparse ratio between every two single particles.

To the application of unidirectional light emitting, the aforesaid structures are adopted to form the straight or curved coated area of the visible light layer. A reflection angle can be formed between an arbitrary point in the coated area and the reflection dome. While the coated area extracts lights, the reflection angle can have the extracted lights, reflected by the reflection dome, not to penetrate the coated area itself. Upon such an arrangement, a high-efficient light-extraction apparatus can thus be obtained.

Further, for the optical film can have the ultraviolet or blue lights, either after a first reflection or after plural reflections, to project again onto the fluorescent or phosphorescent particles, then the coating of the fluorescent or phosphorescent particles can be made much thinner and sparser. The aforesaid blocking phenomenon during extracting the excited visible lights can be greatly reduced, and thus the object in improving the light extraction performance can be obtained. On the other hand, in the uncoated area of the visible light layer, under a high reflection rate (up to 99.5% or above) of the optical film, the ultraviolet or blue lights can still project on the fluorescent or phosphorescent particles in the coated area, after a plurality of reflections. The purpose of plural reflections is to avoid energy exhaustion caused by the ultraviolet or blue lights not to project on the fluorescent or phosphorescent particles.

For example, for a light with a wavelength of 184.9 nm or 253.7 nm, the reflection rate of the optical film for the 0~±90 degrees of angle of reflection is theoretically high to 99.8%. Further, after 26 times of reflection, the reflection rate for 99.8% of the lights can be still high to 94.9%. For example, in the art, if the fluorescent or phosphorescent particles can achieve an average ½ coverage of the coated area, it is about ½ of the one-reflection ultraviolet lights can project on the fluorescent or phosphorescent particles, and also about ½ of the one-reflection ultraviolet lights are wasted for not to project on the fluorescent or phosphorescent particles. However, if the wasted ultraviolet lights can have the chance to perform the second reflection after hitting at the optical film, then another ½ of the wasted lights can be re-projected onto the fluorescent or phosphorescent particles. Namely, after the second reflection, only ¼ of the ultraviolet lights are wasted by not to project on the fluorescent or phosphorescent particles. By introducing the whole dielectric optical film with a 0~90-degree wide angle of reflection, reflection for any ultraviolet light is possible at any arbitrary angle. That is the wasted lights can always have a second chance to re-project on the fluorescent or phosphorescent particles; i.e., the reflection can be never stopped. Upon such an arrangement, the light penetration rate for the thin and sparse coated area of the visible light layer can be greatly improved.

In addition, for an average ⅑ coverage (i.e. 11.1% coated, 88.9% uncoated) of the fluorescent or phosphorescent particles in the visible light layer, 95.3% of the ultraviolet lights after 26 times of reflection can project on the 11.1%-coverage fluorescent or phosphorescent particles; i.e., 1−(0.889^26=4.692%)=95.3%. Anyway, it is still 4.692% of the ultraviolet or blue lights are wasted. Theoretically, the 11.1%-coverage of the fluorescent or phosphorescent layer is the sparsest coating that can be achieved for obtaining an optimal penetration rate of the visible lights. Under the circumstance of repeatedly reflecting the excited lights with a high reflection rate, the preferred 11.1%-coverage of the fluorescent or phosphorescent layer can be further reduced to a 5%-coverage, or relaxed up to 20%, 30%, 40%, 50%, 60%, 70%, 80%, 90%, and even 95% of coverage.

In the art, for a thinner coated area of the visible light layer, the thickness of the particle layer is averagely ranged from 20 μm to 30 μm, the acceptable granular size (in diameter) for the particle layer can be 1 μm, 2 μm, 5 μm, 10 μm, 20 μm, 60 μm, or 100 μm, and the visible light layer includes at least at least 3 or 4 laminated particle layers. However, in accordance with the present invention, the particle coating can be made thinner and sparser. More spacings would be introduced to exist between the particle piles, between the particle pile and the single particle, and between the single particles. The average thickness of the particle piling is about 1 μm or 2 μm to about 50 μm. In the coated area, the ratio of the total projection area of the spacings to the total projection area of the particle piles and the single particles is larger than 5% and less than 95% (included); preferably, larger than 10% and less than 85% (included); more preferably, larger than 20% and less than 75% (included); and, most preferably, larger than 30% and less than 65% (included).

While the coated area of the visible light layer is excited to emit the visible lights, the conventional light-blocking problem happened to the downward extraction (about 90 degree downward) and the upward extraction (about 90 degree upward) can be resolved by introducing a transparent hollow casing for housing thereinside the ultraviolet or blue light source in accordance with the present invention. The transparent casing can be completely or portionally coated by the mono-layered fluorescent or phosphorescent layer. However, for the particles of the fluorescent or phosphorescent coating can't fit to each other in a particle-wise, so the ultraviolet or blue lights might leak through the inter-particle spacing. To avoid possible energy loss or waste thereabout, the first step in accordance with the present invention is to introduce a transparent hollow casing which can allow the visible lights to penetrate but reflect portionally or completely, in a multiple reflectional manner, the ultraviolet or blue lights with specific wavelengths. Also, in the present invention, the particles are formed in a mono-layered manner; i.e., not to pile up each other (in particular, minor particle piling can be accepted). Upon such an arrangement of the coated area of the visible light layer for the fluorescent or phosphorescent particles, following objects can be achieved while the visible lights are excited: (a) the downward extraction of the visible lights needn't pass through any other particle layer (for including only a mono-layer) before the visible lights reach outside, and thus the brightness wouldn't be substantially reduced; and (b) the upward extraction of the visible lights won't be substantially effected by the height differences of the neighboring particles (for sparsely scattering), and thus the brightness wouldn't be reduced and thereby the illumination performance can be ensured. In the present invention, the ultraviolet lights A, B and C are to have individual wavelengths ranged from 100 nm~380 nm, the ultraviolet lights A, B and C are to have individual wavelengths ranged from 100 nm~380 nm, the blue light is to have a wavelength ranged from 380 nm~525 nm, the green light is to have a wavelength ranged from 525 nm~600 nm, the red light is to have a wavelength ranged from 600 nm~780 nm, and the visible light is to have a wavelength ranged from 380 nm~780 nm.

While the coated area of the visible light layer is excited to emit the visible lights, the horizontal light extraction (±90 degrees around the horizontal line at both directions) would be portionally blocked by the neighboring particles. The second step of the present invention is to remove or reduce the aforesaid blocking situation by distancing further the neighboring particles and/or by reducing the number of the particle piles. For the horizontal light extraction (sideward directions of the visible lights) upon the crowd fluorescent or phosphorescent particles on the mono-layer, the blocking situation would be significant. If the distance between neighboring single particles can be further pulled away, then the blocking angle with respect to the neighboring single particle would be substantially reduced. The blocking angle would be further reduced if the spacing between neighboring single particles can be further increased. For example, to a ⅑-coverage (11.1%-coverage) of the visible light layer (i.e., one of every nine unit areas is coated with the fluorescent or phosphorescent particles, then the aforesaid blocking angle would be about 15 degrees for a 2 μm-cubic fluorescent or phosphorescent layer. Apparently, by introducing the sparsely scattering mono-layered distribution to the coated area of the visible light layer, the illumination performance for the lighting set can be further improved.

If the distanced single particles are coated to a straight wall, the blocking angle for the horizontal light extraction would be further reduced, for the straight wall perform less neighboring blocking with respect to the transparent hollow casing. Hence, the illumination performance would be substantially elevated for the lighting set with a straight-surface visible light layer.

For example, to a lighting set having a visible light layer with an 11.1% coated area and an 88.9% uncoated area, it is about 11.1% single particles to be projected by the first-projection ultraviolet or blue lights, and 88.9% of the light energy is wasted at the first projection. But if a 184.9 nm or 253.7 nm optical film with 0~±90 AOR and able to achieve a 99.8% reflection rate, then, after 25 times of reflections, there are still 94.7% of the lights able to hit at the fluorescent or phosphorescent particles that provide the 11.1% mono-layered coverage in the visible light layer. Namely, only 5.3% of the source ultraviolet or blue lights are wasted.

For the application on the illumination of the mercury gas, the wavelength of the shortwave lights for the optical film can be 253.7 nm for 0~±90 (0°~±90°) AOR, stacked by a plurality of coating with 184.9 nm for 0°~±90°) AOR. In some other applications, the mercury gas can also be replaced by the He gas, the Ne gas, the Ar gas, the Kr gas, the Xe gas, the Rn gas, the mixture of the aforesaid gases or hi-temperature metallic gas. The least AOR to meet the minimum requirement is at least 0~±30 degrees up to 0~±90 degrees, or 0~±45 degrees up to 0~±90 degrees. For the circular light tube with a circular cross section, the AOR for an arbitrary point in the semicircle is less than or equal to 30 degrees with respect to the circumference. In particular, any point in the circle has an AOR less than or equal to 90 degrees with respect to the circumference.

In the application of the blue lights, it is understood that some of the blue lights are needed in mixture to produce white lights, and so the optical film is formed as a portional coating onto the interior or exterior wall of the transparent casing. (a) The optical film is able to completely reflect all wavelengths of the blue lights but to allow the red lights and the green lights to penetrate therethrough. Anyway, small spacing is still needed for leaking some blue lights to mix with other lights for forming the final white lights. The smaller the spacing is, the sparser can be the scattering of the particles in the visible light layer. Or, (b) the optical film can only reflect portion of the blue lights, the un-reflected blue lights are to penetrate through the optical film with the red lights and the green lights, so as to mix together for producing the white lights. In the aforesaid application on the blue lights, the AOR is preferred to be between 0 and 30 degrees. For the longwave after passing the film would be shifted toward to become a shortwave, so the mixture for producing the white lights must be precise.

The last step of the present invention is to reduce the blocking problem in the unidirectional illumination application by including a reflection dome for reflection the visible lights. The reflection dome can accommodate thereinside the transparent casing having the coated area of the visible light layer. Preferably, the coated area of the visible light layer is a straight wall, an extension of the straight wall is to meet the ground point at the bottom of the reflection dome. The reflection dome can be in a plane shape or an arc shape. Except the ground point, any point in the reflection dome can form an AOR with the wall coated the visible light layer. The AOR is able to have the lights extracted from the coated area of the visible light layer and reflected then by the reflection dome not to penetrate the coated area of the visible light layer itself. Thus, a high performance in illumination can be expected.

In a further more aspect of the present invention, a high-performance light-emitting apparatus is provided to greatly reduce the mutual-blocking problem for the light extraction of the coated area of the visible light layer. It is also called the improved apparatus for light extraction of the coated area of the visible light layer. The improved apparatus comprises:

a transparent casing, formed as a transparent hollow sealed body including an interior wall, an opposing exterior wall and supporting members structured inside the casing;

a light-exciting area, located inside the transparent casing to produce ultraviolet lights or blue lights to excite a visible light coating for further producing corresponding visible lights;

an optical film, formed as a whole dielectric multi-layered coating film with at least providing an optical long-pass filtration function, coated to the interior or exterior wall of the transparent casing, occupying at least 60% in area of the light-exciting area, preferably at least 90% (90%~100%); wherein the optical film can completely reflect the ultraviolet lights with specific wavelengths and completely or portionally reflect the blue lights, and wherein the optical film can allow the lights including at least the visible lights to penetrate therethrough; and a coated area of the visible light layer, formed as a coating of a fluorescent or phosphorescent layer for exciting completely or portionally the blue lights or exciting completely the ultraviolet lights into corresponding visible lights, coated completely or portionally onto either the interior wall the transparent casing or the supporting surface formed inside the transparent casing.

With respect to the position of the optical film, the coated area of the visible light layer is located closer to the light-exciting area. In particular, the coated area is located inside the light-exciting area. In the coated area, the ratio of the total area of the spacing among the particle piles and the single particles to the total projection area of the coated area is larger than 5% but less than 90% (including), preferably larger than 5% but less than 80% (including), more preferably larger than 5% but less than 70% (including), also more preferably larger than 5% but less than 60% (including), and the most preferably larger than 5% but less than 30% (including). The coated area is consisted of particle piles or/and single particles. The fluorescent or phosphorescent particles in the coated area is sparsely scattered, i.e. in a manner of rarefaction coating or sparse coating), such that the particle pile or the single particle layer can present more spacing between particles. Therefore, in the vertical projection of the coated area upon the coating surface, the coated block or any surface in the coated block, the projected area of the particle pile and the single particle (Aps) and the total projection area (Av) of the vacant space (v) are kept in a fixed sparse distributed ratio (1), which is R1(uv)=Aps/(Aps+Av)=5%~95% for the ultraviolet light application and R1(bu)=Aps/(Aps+Av)=5%~85% for the blue light application. Both of the aforesaid two ratios are called as the sparse excited coating of visible light. In the foregoing description, the single particle stands for the isolated particle in the coating, and the particle pile is for a local solid piling including at least two particles. The fixed sparse distributed ratio (1-1) for the very even and also sparse excited coating of visible light among the particle piles and the single particles is defined to keep a fixed distance between any two neighboring particle piles, between any two neighboring single particles, or between any two neighboring particle pile and the single particle. The sparse coating for forming the visible light is positive to further reduce the number of the particle piles in the visible light layer.

In the coated area of the visible light layer including the surface consisted of the particle piles p and the individual single particles s crowded together or the surface in the coated block, the thinnest single particle excited coating layer of visible light (2) is defined by a fixed ratio R2=As/(Ap+As+Av), in which 2%≤R2≤98%, the As is the total vertical projection surface of the particle piles p and the single particles s in the coated area with respect to the coated surface, and the Av is the total projection surface of the spacings Av.

By introducing the sparse scattering coating to the thinnest single particle excited coating layer of the visible light, a larger spacing v would be generated between the single particle and another single particle. In the coated area of the visible light layer including the coating surface and the surface in the coated block, the single particle thinnest and sparsest excited coating layer of visible light (3) is defined by a fixed sparse ratio R3=As/(As+Av)=15%~85%, in which the As is the total projection area of the single particles, the Av is the total projection area by summarizing the As and the total projection area of the spacings v.

Further, the very even single particle and also thinnest and sparsest excited coating layer of visible light (3-1) are defined by further distributing the single particles so as to keep a fixed sparse ratio between every two single particles.

In the aforesaid improved apparatus for light extraction of the coated area of the visible light layer, the transparent hollow casing can be formed as a sphere, a hemisphere, a quasi-sphere, or a spherical portion. The light-exciting area can be formed as a spherical area. The high-reflection-rate wide AOR $\alpha$ of the optical film is ranged between 0 degree (including) and 90 degree (including). The foregoing optical film is to reflect the ultraviolet or blue lights but to allow the visible lights to penetrate therethrough. The distance of any arbitrary point A on the reflection layer of the optical film to the spherical center B of the light-exciting area is defined as a distance C. The line connecting A and B is the normal line of the reflection light passing A. The distance of point A on the reflection layer to its own tangential point to the external circumference of the light-exciting area is defined as a distance b. The radius of the light-exciting area is defined as an r. The incident angle of A on the reflection layer of the optical film is $\alpha$. Then, $C \geq \csc\alpha \times r$ and $0° \leq \alpha \leq 90°$. In particular, for the application of the blue light, the preferred a includes the range of (0°, ±15°).

In the aforesaid improved apparatus for light extraction of the coated area of the visible light layer, the transparent casing can be formed as a tube, a U-shape tube, a W-shape tube, an O-shape tube, a B-shape tube, a circular elliptical-shape tube, a circular square-shape tube, or a circular rectangle-shape tube. The cross section thereof can be a circle, a semi-circle, an arc portion, an elliptical, a square, a rectangle, a triangle, a trapezoid or a cone. The light-exciting area is located inside the transparent casing. The high-reflection-rate wide AOR $\alpha$ of the optical film is ranged between 0 degree (including) and 90 degree (including). The high-reflection-rate wide angle of incidence (AOI) of the optical film is ranged between 0 degree (including) and 90 degree (including). Between 0 degree (including) and 90 degree (including) of the AOI, at least 30 degrees of the wide AOR $\alpha$ can be obtained (i.e., (0°~($\alpha \geq 30°$)

~90°), or preferably at least 45 degrees of the wide AOR α can be obtained (i.e., (0°~(α≥45°)~90°). In the application of the ultraviolet lights, the preferable wide AOR α is in the range of 0°≤α≤90°.

In the aforesaid improved apparatus for light extraction of the coated area of the visible light layer, the light-exciting area is to emit the ultraviolet or blue lights, and can be formed by (1) at least one induction lamp located inside or outside the transparent casing, which is electromagnetically triggered to have the gas to discharge for light-emitting; (2) at one LED device that can emit the ultraviolet or blue lights; (3) at least one gas-discharge light-emitting tube; or, (4) at least one discharge electrode located in the light-exciting area.

In the aforesaid improved apparatus for light extraction of the coated area of the visible light layer, a transparent sealed inner cell is structured inside the transparent casing, and the light-exciting area is located between the transparent casing and the transparent sealed inner cell. The transparent casing can be formed as a tube, a U-shape tube, a W-shape tube, an O-shape tube, a B-shape tube, a circular elliptical-shape tube, a circular square-shape tube, or a circular rectangle-shape tube. The cross section thereof can be a circle, a semi-circle, an arc portion, an elliptical, a square, a rectangle, a triangle, a trapezoid or a cone. The high-reflection-rate wide angle of incidence (AOI) of the optical film is ranged between 0 degree (including) and 90 degree (including). Between 0 degree (including) and 90 degree (including) of the AOI, at least 30 degrees of the wide AOR α can be obtained (i.e., (0°~(α≥30°)~90°), or preferably at least 45 degrees of the wide AOR α can be obtained (i.e., (0°~(α≥45°)~90°). In the application of the ultraviolet lights, the preferable wide AOR α is in the range of 0°≤α≤90°.

In the aforesaid improved apparatus for light extraction of the coated area of the visible light layer, the light-exciting area is to emit the ultraviolet or blue lights, and can be formed by (1) at least one induction lamp located inside or outside the transparent casing, which is electromagnetically triggered to have the gas to discharge for light-emitting; (2) at one LED device that can emit the ultraviolet or blue lights; (3) at least one gas-discharge light-emitting tube; or, (4) at least one discharge electrode located in the light-exciting area.

In the aforesaid improved apparatus for light extraction of the coated area of the visible light layer, the optical film is a carved coating film, preferably a well-distributed carved coating film.

In the aforesaid improved apparatus for light extraction of the coated area of the visible light layer, the gas-discharging light-emitting tube is mounted inside the light-emitting area in a swirl manner.

In the aforesaid improved apparatus for light extraction of the coated area of the visible light layer, the particles in the coated area of the visible light layer are to have an average thickness of about 1~2 μm to 50 μm.

In the aforesaid improved apparatus for light extraction of the coated area of the visible light layer, the granular size (in diameter) of the particles in the coated area of the visible light layer is in average between 1~2 μm and 100 μm, preferably to have a granular size of about 2 μm.

In the aforesaid improved apparatus for light extraction of the coated area of the visible light layer, the coated area of the visible light layer is formed by a straight upright wall.

In the aforesaid improved apparatus for light extraction of the coated area of the visible light layer, a reflection dome for reflecting the visible lights is included. The reflection dome can be a metallic lamp shadow, a silver or aluminum reflection layer inside the casing, an internal mirror, an exterior mirror, or lamp housing. The reflection dome is shaped as a hollow hemisphere or a portion of a sphere with at least one internal spherical transparent body. The largest depth of the reflection dome is larger than the height of the internal spherical transparent body (i.e., the height where the coated area of the visible light layer is constructed). Preferably, the coated area of the visible light layer is coated to an upright straight wall, and an extension of the straight wall is to meet a ground point at the bottom of the reflection dome.

In the aforesaid improved apparatus for light extraction of the coated area of the visible light layer, a reflection dome for reflecting the visible lights is included. The inner curved surface (the reflection wall) of the reflection dome is formed as a hollow hemisphere or a portion of a sphere with a whole dielectric multi-layered reflection film. A light-exciting area d1 is formed as a spherical area and is concentric, by a predetermined distance, with the inner curved wall of the reflection dome. At least one of the internal spherical transparent body is located inside the light-exciting area d1 (inside the reflection dome as well). The position of the coated area of the visible light layer at the internal spherical transparent body is located inside the opening surface of the reflection dome. Preferably, the coated area of the visible light layer is coated to an upright straight wall, and an extension of the straight wall is to meet a ground point at the bottom of the reflection dome. The distance of any arbitrary point A1 on the reflection layer of the whole dielectric reflection film to the spherical center B1 of the light-exciting area d1 is defined as a distance C1. The line connecting A1 and B1 is the normal line of the reflection light passing A1. The distance of point A1 on the reflection layer to its own tangential point to the external circumference of the light-exciting area is defined as a distance b1. The radius of the light-exciting area d1 is defined as an r1. The incident angle of A1 on the reflection layer of the optical film is α1. Then, $C1 \geq \csc\alpha 1 \times r1$ and $0° \leq \alpha 1 \leq 90°$, preferably $0° \leq \alpha 1 \leq 45°$.

In the aforesaid improved apparatus for light extraction of the coated area of the visible light layer, a reflection dome for reflecting the visible lights is included. The reflection dome can be a metallic lamp shadow, a silver or aluminum reflection layer inside the casing, an internal mirror, an exterior mirror, an optional accessory or lamp housing. The reflection dome is shaped as a tube with a half-circle cross section or a smaller arc portion with respect to the half-circle cross section. The aforesaid tube has a longitudinal opening for exposing the internal reflection wall of the reflection dome, and at least one internal longitudinal tubular transparent body. The largest depth of the reflection dome is larger than the height where the coated area of the visible light layer is on the transparent body. Preferably, the coated area of the visible light layer is coated to an upright straight wall, and an extension of the straight wall is to meet a ground point at the bottom of the reflection dome.

The aforesaid largest depth of the reflection dome is larger than the height at which position the coated area of the visible light layer is on the transparent body. Namely, the radius of the reflection dome is larger than the elevation of the coated area of the visible light layer on the internal transparent body inside the arc structure range of the reflection dome. Upon such an arrangement, the AOI of the visible lights emitted from the coated area of the visible light layer and hitting at any point on the reflection dome with respect to the line connecting the any point and the center of the reflection dome can be larger than zero degree. Thereby, the reflected light from the any point can no more hit at the visible light layer again, thus the brightness won't be reduced, and the light-emitting performance can be ensured.

By providing the present invention, the mono-layered coating of the fluorescent or phosphorescent particles on the transparent body is homogeneously laid, either by a sparse scattering single-layered coating or by an even-distributed monolayed coating. Thereupon, the shortcoming of blocking the visible lights emitted by the fluorescent or phosphorescent particles can be substantially avoided. Thus, the light-emitting performance can be efficiently ensured. In addition, the lighting energy of the ultraviolet or blue lights can be thoroughly utilized by the multiple reflection capability inside the transparent body. Also, the material cost for forming the coated area of the visible light layer can be reduced. Accordingly, the aforesaid blocking problem can thus be resolved in the present invention. Namely, in the present invention, the coating arrangement of the fluorescent or phosphorescent particles is sparse enough so as to make the light-blocking problem impossible, and thereby the energy of the ultraviolet or blue lights can be efficiently saved so as to reach a high level of electric-photo energy transformation. Further, the $CO_2$ exhaustion can be reduced by saving the energy, such that benefits to the planet as well.

In accordance with the aforesaid technique of obtaining the visible lights by exciting the ultraviolet or blue lights provided by the present invention, the application platform can be LEDs, EL lamps, electromagnetic induction lamps, and so on. No matter whether the applicational medium is the mercury gas or any other appropriate non-mercury gas such as the Xe gas, the Ne gas, or metal steam. As long as the apparatus utilizes the fluorescent or phosphorescent coating to generate the visible lights, the aforesaid shortcomings do always exist to be improved. Thus, all those apparatuses can introduce the teaching of the present invention to improve those apparatus themselves. In summary, by providing the present invention, following two advantages can be immediately obtained: (1) increase greatly in the penetration rate of the visible lights, and (2) reduction of the light-blocking phenomenon among the fluorescent or phosphorescent particles. That is the light-emitting performance can be easily assured.

In accordance with the present invention, one of the same inventor's inventions can be the platform to build up the improvement taught by the present invention. The aforesaid platform invention is duplicated literaturally as follows in a claim format. The platform invention can be recited as:

1. An light-emitting device, comprising:

a transparent sealed body, including a first internal wall, a second internal wall, a first external wall opposing to the first internal wall, and a second external wall opposing to the second internal wall;

an electroluminescence gas, filled inside the transparent sealed body for providing at least an ultraviolet light with a specific wavelength;

an electroluminescence light layer, coated on one of the first internal wall, a transparent separator at the first internal wall, the second internal wall, a transparent separator at the second internal wall, the first external wall, a transparent separator at the first external wall, the second external wall, a transparent separator at the second external wall and a transparent separator inside the transparent sealed body, the electroluminescence light layer being to absorb the ultraviolet light with a specific wavelength so as to providing a corresponding visible light; and a whole dielectric optical multi-layer film with a wide angle of incidence (AOI), for reflecting the at least one ultraviolet light with a specific wavelength but allowing the visible light to penetrate therethrough, providing a 0°~90° wide AOI feature with respect to the reflected ultraviolet light with the specific wavelength, the whole dielectric optical multi-layer film with the wide AOI being coated onto one of the first internal wall, a transparent separator at the first internal wall, the second internal wall, a transparent separator at the second internal wall, the first external wall, a transparent separator at the first external wall, the second external wall, a transparent separator at the second external wall, the electroluminescence light layer being located closer to the electroluminescence gas with respect to the whole dielectric optical multi-layer film with the wide AOI.

2. The light-emitting device according to claim 1, wherein the whole dielectric optical multi-layer film with the wide AOI has an average reflection rate of 95% with respect to the ultraviolet light with the specific wavelength.

3. The light-emitting device according to claim 1, wherein, in order to increase the penetration rate of the visible light, an anti-reflection (AR) film is coated onto an opposing surface with respect to a surface of a glass coated the whole dielectric optical multi-layer film with the wide AOI.

4. The light-emitting device according to claim 1, wherein the ultraviolet light with the specific wavelength of the electroluminescence gas has a wavelength selected from the group of 253.7 nm, 184.9 nm, 147 nm and 173 nm.

5. The light-emitting device according to claim 1, wherein the whole dielectric optical multi-layer film with the wide AOI is made of a material selected from the group of $HfO_2$ (Hafnium Dioxide), $LaF_3$ (Lanthanum Trifluoride), $MgF_2$ (Magnesium Fluoride), and $Na_3AlF_6$ (Sodium Hexafluoroaluminate).

6. The light-emitting device according to claim 1, wherein the electroluminescence light layer is a fluorescent or phosphorescent layer formed as a straight wall.

7. The light-emitting device according to claim 1, further including a reflection layer coated on the transparent sealed body or the first external wall, wherein the electroluminescence light layer is closer to the electroluminescence gas over the reflection layer.

8. The light-emitting device according to claim 1, wherein the electroluminescence light layer is formed according to one specific coating manner selected at least one from the group of a point distribution, a block distribution and a strip distribution.

9. The light-emitting device according to claim 1, wherein the transparent sealed body includes thereinside a transparent separator having at least one surface coated with the whole dielectric optical multi-layer film with the wide AOI.

10. An light-emitting device, comprising:

a transparent sealed body, having a first internal wall, a second internal wall, a first external wall opposing to the first internal wall, and a second external wall opposing to the second internal wall;

a transparent sealed inner body, located inside the transparent sealed body;

an electroluminescence gas, filled between the transparent sealed body and the transparent sealed inner body for providing an ultraviolet light;

an electroluminescence light layer, coated onto at least one of the first internal wall, a transparent separator at the first internal wall, the second internal wall, a transparent separator at the second internal wall, the first external wall, a transparent separator at the first external wall, the second external wall, a transparent separator at the second external wall, the electroluminescence light layer being to absorb the ultraviolet light so as to provide a visible light; and a whole dielectric optical multi-layer film with a wide angle of incidence (AOI), for reflecting the at least one ultraviolet light with a specific wavelength but allowing the visible light to penetrate therethrough, providing a 0°~90° wide AOI feature with respect to the reflected ultraviolet light with the specific wavelength, the whole dielectric optical multi-layer film with the wide AOI being coated onto one of the first internal wall, a transparent separator at the first internal wall, the second internal wall, a transparent separator at the second internal wall, the first external wall, a transparent separator at the first external wall, the second external wall, a transparent separator at the second external wall, the electroluminescence light layer being located closer to the electroluminescence gas with respect to the whole dielectric optical multi-layer film with the wide AOI.

11. The light-emitting device according to claim 10, wherein the whole dielectric optical multi-layer film with the wide AOI has an average reflection rate of 95% with respect to the ultraviolet light with the specific wavelength.

12. The light-emitting device according to claim 10, wherein the ultraviolet light with the specific wavelength of the electroluminescence gas has a wavelength selected from the group of 253.7 nm, 184.9 nm, 147 nm and 173 nm.

13. The light-emitting device according to claim 10, wherein the whole dielectric optical multi-layer film with the wide AOI is made of a material selected from the group of $HfO_2$ (Hafnium Dioxide), $LaF_3$ (Lanthanum Trifluoride), $MgF_2$ (Magnesium Fluoride), and $Na_3AlF_6$ (Sodium Hexafluoroaluminate).

14. The light-emitting device according to claim 10, wherein the electroluminescence light layer is a fluorescent or phosphorescent layer formed as a straight wall.

15. The light-emitting device according to claim 10, further including a reflection layer coated on the transparent sealed body or the first external wall, wherein the electroluminescence light layer is closer to the electroluminescence gas over the reflection layer.

16. The light-emitting device according to claim 10, wherein the electroluminescence light layer is formed according to one specific coating manner selected at least one from the group of a point distribution, a block distribution and a strip distribution.

17. The light-emitting device according to claim 10, wherein, in order to increase the penetration rate of the visible light, an anti-reflection (AR) film is coated onto an opposing surface with respect to a surface of a glass coated the whole dielectric optical multi-layer film with the wide AOI.

18. The light-emitting device according to claim 10, wherein the transparent sealed body includes thereinside a transparent separator having at least one surface coated with the whole dielectric optical multi-layer film with the wide AOI, and also an internal or external wall of the transparent sealed inner body is coated with the whole dielectric optical multi-layer film with the wide AOI.

19. An light-emitting device, comprising:

a transparent sealed body;

a box-shape transparent sealed shield, accommodating thereinside the transparent sealed body;

an electroluminescence gas, filled inside the transparent sealed body for providing an ultraviolet light;

an electroluminescence light layer, coated onto an internal wall of the box-shape transparent sealed shield or onto at least one surface of a transparent separator inside the box-shape transparent sealed shield, the electroluminescence light layer being to absorb the ultraviolet light for providing a visible light; and a whole dielectric optical multi-layer film with a wide angle of incidence (AOI), for reflecting the at least one ultraviolet light with a specific wavelength but allowing the visible light to penetrate therethrough, providing a 0°~90° wide AOI feature with respect to the reflected ultraviolet light with the specific wavelength, the whole dielectric optical multi-layer film with the wide AOI being coated onto at least one internal wall of the transparent sealed shield, preferably onto all internal walls of the box-shape transparent sealed shield.

20. The light-emitting device according to claim 19, wherein the whole dielectric optical multi-layer film with the wide AOI has an average reflection rate of 95% with respect to the ultraviolet light with the specific wavelength.

21. The light-emitting device according to claim 19, further including a reflection layer coated on an internal or external wall of the box-shape transparent sealed body, or outside to the external wall, wherein the electroluminescence light layer is closer to the electroluminescence gas over the reflection layer.

22. The light-emitting device according to claim 19, wherein the ultraviolet light with the specific wavelength of the electroluminescence gas has a wavelength selected from the group of 253.7 nm, 184.9 nm, 147 nm and 173 nm.

23. The light-emitting device according to claim 19, wherein the whole dielectric optical multi-layer film with the wide AOI is made of a material selected from the group of $HfO_2$ (Hafnium Dioxide), $LaF_3$ (Lanthanum Trifluoride), $MgF_2$ (Magnesium Fluoride), and $Na_3AlF_6$ (Sodium Hexafluoroaluminate).

24. The light-emitting device according to claim 19, wherein the electroluminescence light layer is a fluorescent or phosphorescent layer formed as a straight wall.

25. The light-emitting device according to claim 19, wherein the electroluminescence light layer is formed according to one specific coating manner selected at least one from the group of a point distribution, a block distribution and a strip distribution, but with an uneven distribution with respect to the transparent sealed body, the visible light penetrating the transparent sealed shield in a homogeneous manner.

26. The light-emitting device according to claim 19, wherein, in order to increase the penetration rate of the visible light, an anti-reflection (AR) film is coated onto an opposing surface with respect to a surface of a glass coated the whole dielectric optical multi-layer film with the wide AOI.

Furthermore, the coating material can be selected at least one from the group of $AlF_3$, $Al_2O_3$, $BaF_2$, BeO, $BiF_3$, $CaF_2$, $DyF_2$, $GdF_3$, $HfO_2$, $HoF_3$, $LaF_3$, $La_2O_3$, LiF, $MgF_2$, MgO, NaF, $Na_3AlF_6$, Na5Al3F14, $NdF_3$, $PbF_2$, $ScF_2$, $Si_3N_4$, $SiO_2$, $SrF_2$, $ThF_4$, $ThO_2$, $YF_3$, $Y_2O_3$, $YbF_3$, $Yb_2O_3$, $ZrO_2$ or $ZrO_3$.

In accordance with the present, a light-extraction apparatus for an optical-film lighting set having a visible-light coating comprises:

a shell body;

an optical film coated inside the shell body;

a visible light layer, consisted of one of fluorescent particles and phosphorescent particles, the one of fluorescent particles and phosphorescent particles being coated onto the shell body in a predetermined scattering manner; and at least one supporting member, mounted inside the shell body.

The visible light layer is coated inside the shell body in a manner of sparse scattering. The supporting member is located inside the shell body. Typically, the visible layer is coated onto an interior wall of the shell body or onto other component inside the shell body, preferably onto the supporting member.

In one embodiment of the present invention, the optical film is characterized in a wide angle of incidence (AOI) to reflect the ultraviolet light but to allow the visible light to penetrate therethrough, in which the wide AOI is ranged from 0~90 degrees or from 0~30+ degrees to 90 degrees of angle of reflection (AOR). The ultraviolet light with the specific wavelength of the electroluminescence gas has a wavelength selected from the group of a pair of (one of 253.7 nm±2 nm and 253.7 nm±2 nm, and 184.9 nm±2 nm) and another pair of (one of 147 nm±2 nm and 147 nm±2 nm, and 173 nm±2 nm).

In one embodiment of the present invention, the optical film and the visible light layer are both coated onto the exterior wall and the interior wall of the shell body, or only coated onto the interior wall of the shell body, in which the optical film is coated closer to the interior wall of the shell body.

In one embodiment of the present invention, a wall of the shell body includes a coated area (A) coated by the visible light layer and the rest of the wall other than the coated area (A) is defined as an uncoated area (B), wherein the coated area (A) occupies 1%~99% of the wall.

In one embodiment of the present invention, the interior wall of the shell body includes a coated area (A) coated by the visible light layer and the rest of the interior wall other than the coated area (A) is defined as an uncoated area (B), wherein the coated area (A) occupies 1%~99% of the interior wall.

In one embodiment of the present invention, particles in the coated area of the visible light layer are sparsely scattered into a monolayer structure, in which the granular size (in outer diameter) of the particles is ranged from 1 μm or 2 μm to 50 μm, or even to about 100 μm.

In one embodiment of the present invention, 1%~99% of a total area of the coated area (A) is an integrated area (X) of the granular coverage (A2) of the particles of the visible light layer, and the rest (Y) of the total area is contributed by integrating areas for inter-particle spacings (A1).

In one embodiment of the present invention, ranges for the X and the Y are formed as a pair selected from one of combinations: (99%>X≥90%, 0%≤Y<10%), (90%>X≥80%, 10%≤Y<20%), (80%>X≥70%, 20%≤Y<30%), (70%>X≥60%, 30%≤Y<40%), (60%>X≥50%, 40%≤Y<50%), (50%>X≥40%, 50%≤Y<60%), (40%>X≥30%, 60%≤Y<70%), (30%>X≥20%, 70%≤Y<80%), and (20%>X≥1%, 80%≤Y<99%).

In one embodiment of the present invention, the shell body is located inside a reflection dome further having an internal wall for coating a reflective layer.

In one embodiment of the present invention, the visible light layer is formed as a straight wall.

In one embodiment of the present invention, the reflective layer is one of a dielectric reflective membrane and a silver-aluminum film, and the reflective dome is formed to have a volume larger than a hemisphere (i.e. having a maximum depth larger than a radius of the hemisphere).

In one embodiment of the present invention, the visible light layer is a straight wall, the reflective layer is one of a dielectric reflective membrane and a silver-aluminum film, and the reflective dome is formed to have a volume larger than a hemisphere (i.e. having a maximum depth larger than the height of the straight wall).

In one embodiment of the present invention, the shell body further includes an illumination part for emitting the ultraviolet or blue lights.

In one embodiment of the present invention, a distance between an arbitrary point A on the optical film and a center point B of the illumination part is defined as a c, a normal line for the AOR at the point A is the line connecting the point A and the point B, a distance between the point A and a tangential point at a rim of the illumination part with respect to the point A is defined as a b, the radius of the illumination part is defined as an r, the AOI at the point A is define as an α, and then $c \geq \csc\alpha \times r$ for $0° \geq \alpha \geq 60°$.

In one embodiment of the present invention, the optical film is coated onto the interior or exterior wall of the shell body, the visible light layer is coated onto the supporting member, a portion of a surface of the supporting member coated by the visible light layer is defined as a coated area (AS), a rest portion of the surface of the supporting member is defined as an uncoated area (BS), and the coated area (AS) occupies 1%~99% in area of the surface. In the coated area of the visible light layer, the particles are coated in a scattering manner and in a form of monolayer coating, and the particles have granular sizes (in outer diameter) ranged from 1 μm to 50 μm, or even up to about 100 μm.

In one embodiment of the present invention, 1%~99% of a total area of the coated area (AS) is an integrated area (X1) of the granular coverage (AB) of the particles of the visible light layer, and the rest (YS) of the total area is contributed by integrating areas for inter-particle spacings (AG), in which ranges for the X1 and the YS are formed as a pair selected from one of combinations: (99%>X1≥90%, 0%≤YS<10%), (90%>X1≥80%, 10%≤YS<20%), (80%>X1≥70%, 20%≤YS<30%), (70%>X1≥60%, 30%≤YS<40%), (60%>X1≥50%, 40%≤YS<50%), (50%>X1≥40%, 50%≤YS<60%), (40%>X1≥30%, 60%≤YS<70%), (30%>X1≥20%, 70%≤YS<80%), and (20%>X1≥1%, 80%≤YS<99%).

In one embodiment of the present invention, a discharge gas is filled between the shell body and the supporting member.

In one embodiment of the present invention, a discharge gas is filled inside the supporting member, and the supporting member is formed to be one of a sphere and a tube.

In one embodiment of the present invention, at least one auxiliary supporting member is mounted between the shell body and the supporting member.

In one embodiment of the present invention, the visible light layer is coated to one surface of the auxiliary supporting member, the optical film is coated to one of an interior wall and an exterior wall of the shell body, and the auxiliary supporting member is formed as one of a plate and a board.

In one embodiment of the present invention, a surface of the auxiliary supporting member includes a coated area (AAS) coated by the visible light layer and the rest of the surface other than the coated area (AAS) is defined as an uncoated area (BAS), wherein the coated area (AAS) occupies 1%~99% of the surface. The particles and phosphorescent particles in the coated area (AAS) are coated in a sparse scattering manner, and the scattered particles are arranged in a form of monolayer coating and have granular sizes ranged from 1~2 μm to 50 μm, even up to 100 μm.

In one embodiment of the present invention, 1%~99% of a total area of the coated area (AAS) is an integrated area (X2) of the granular coverage (AAB) of the particles of the visible light layer, the rest (YAS) of the total area is contributed by integrating areas for inter-particle spacings (AAG), and ranges for the X2 and the YAS are formed as a pair selected from one of combinations: (99%>X2≥90%, 0%≤YAS<10%), (90%>X2≥80%, 10%≤YAS<20%), (80%>X2≥70%, 20%≤YAS<30%), (70%>X2≥60%, 30%≤YAS<40%), (60%>X2≥50%, 40%≤YAS<50%), (50%>X2≥40%, 50%≤YAS<60%), (40%>X2≥30%, 60%≤YAS<70%), (30%>X2≥20%, 70%≤YAS<80%), and (20%>X2≥1%, 80%≤YAS<99%).

Further, in accordance with the present invention, a light-extraction apparatus for an optical-film lighting set having a visible-light coating comprises:

a shell body;

an optical film coated on the shell body;

a visible light layer, consisted of one of fluorescent particles and phosphorescent particles, the one of fluorescent particles and phosphorescent particles being coated on the shell body in a predetermined scattering manner; and a plurality of supporting members, mounted inside the shell body.

In one embodiment of the present invention, the optical film is coated onto an interior wall of the shell body, and the optical film is characterized in a wide AOI to reflect at least one specific ultraviolet light but to allow visible lights to penetrate therethrough, in which the wide AOI is ranged from 0~90 degrees or from 0~30+ degrees to 90 degrees of angle of reflection (AOR). The ultraviolet light with the specific wavelength of the electroluminescence gas has a wavelength selected from the group of a pair of (one of 253.7 nm±2 nm and 253.7 nm±2 nm, and 184.9 nm±2 nm) and another pair of (one of 147 nm±2 nm and 147 nm±2 nm, and 173 nm±2 nm).

In one embodiment of the present invention, the supporting member is formed as one of a board, a plate, a tube and a sphere.

In one embodiment of the present invention, the optical film is coated onto the supporting member, and the supporting member is formed as one of the board and the plate.

In one embodiment of the present invention, a surface of the supporting members includes a coated area (AS) coated by the visible light layer, and the rest of the surface other than the coated area (AS) is defined as an uncoated area (BS), in which the coated area (AS) occupies 1%~99% of the surface. The particles in the coated area of the visible light layer are sparsely scattered into a monolayer structure, in which the granular size (in outer diameter) of the particles is ranged from 1 μm or 2 μm to 50 μm, or even to about 100 μm.

In one embodiment of the present invention, 1%~99% of a total area of the coated area (AS) is an integrated area (X1) of the granular coverage (AB) of the particles of the visible light layer, the rest (YS) of the total area is contributed by integrating areas for inter-particle spacings (AG), and ranges for the X1 and the YS are formed as a pair selected from one of combinations: (99%>X1≥90%, 0%≤YS<10%), (90%>X1≥80%, 10%≤YS<20%), (80%>X1≥70%, 20%≤YS<30%), (70%>X1≥60%, 30%≤YS<40%), (60%>X1≥50%, 40%≤YS<50%), (50%>X1≥40%, 50%≤YS<60%), (40%>X1≥30%, 60%≤YS<70%), (30%>X1≥20%, 70%≤YS<80%), and (20%>X1≥1%, 80%≤YS<99%).

In one embodiment of the present invention, an ultraviolet light generator is further included inside the supporting member, and the supporting member is formed as one of a tube and a sphere.

In one embodiment of the present invention, the visible light layer is formed as a straight wall.

In one embodiment of the present invention, the shell body is located inside a reflection dome further having an internal wall for coating a reflective layer, the reflective layer is one of a dielectric reflective membrane and a silver-aluminum film, and the reflective dome is formed to have a volume larger than a hemisphere (i.e. having a maximum depth larger than a radius of the hemisphere).

In one embodiment of the present invention, the visible light layer is a straight wall, the reflective layer is one of a dielectric reflective membrane and a silver-aluminum film, and the reflective dome is formed to have a volume larger than a hemisphere (i.e. having a maximum depth larger than the height of the straight wall).

All these objects are achieved by the light-extraction apparatus for an optical-film lighting set having a visible-light coating described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a light-extraction apparatus for an optical-film lighting set having a visible-light coating. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

DEFINITIONS

Transparent sealed body: a shell body made of a general glass, crystal glass, or any material the like.

Optical film: A film with a wide AOR (0 degree to 90 degrees) to reflect ultraviolet lights but allow visible lights (380 nm~780 nm or 400 nm~800 nm) to penetrate through.

Visible light layer: a layer formed as a fluorescent layer or a phosphorescent layer, made of a material that can excite the ultraviolet light to produce white lights, or another material that can excite blue lights to produce red lights, green lights or yellow lights.

Figure 18:
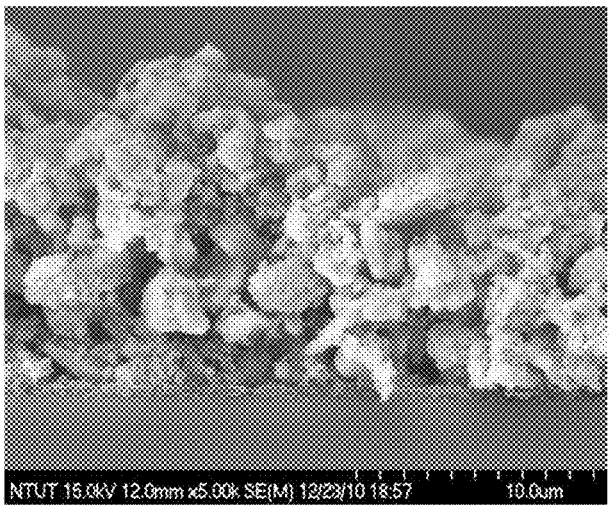
FIG. 18 (Prior art)
FIG. 18 is an SEM view showing the multi-layered piling of particles of FIG. 17.
Figure 37:
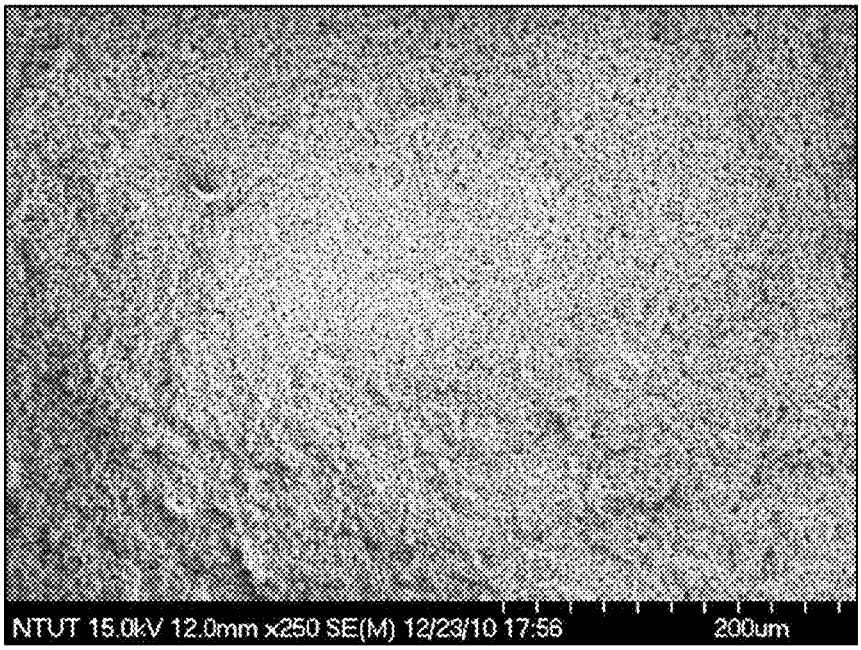
FIG. 37 (Prior art)
FIG. 37 shows schematically an SEM top view of a typical visible light layer on a conventional optical-film light tube, in which a multiple-layered piling of particles is clearly observed.

As shown in FIG. 18 and FIG. 37, they both show a typical prior-art visible light layer, not the sparse-scattering visible light layer in accordance with the present invention.

Figure 38:
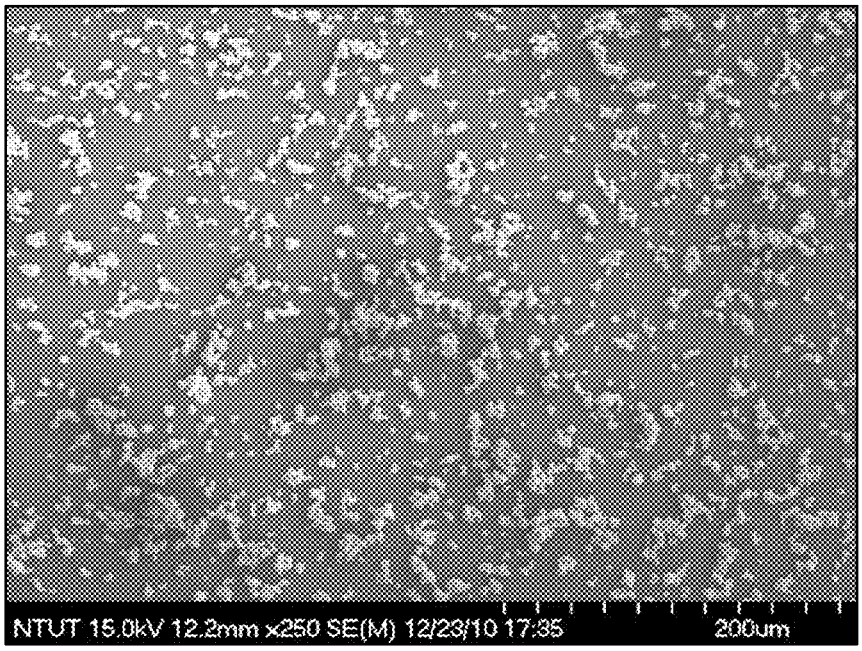
FIG. 38 shows schematically an SEM top view of the visible light layer of the optical-film light tube in accordance with the present invention, in which scattering of particles is clearly observed.

FIG. 38 shows an SEM top view of the visible light layer in accordance with the present invention. As shown, the arrangement of particles in the visible light layer is in a sparse scattering distribution.

Figure 1:
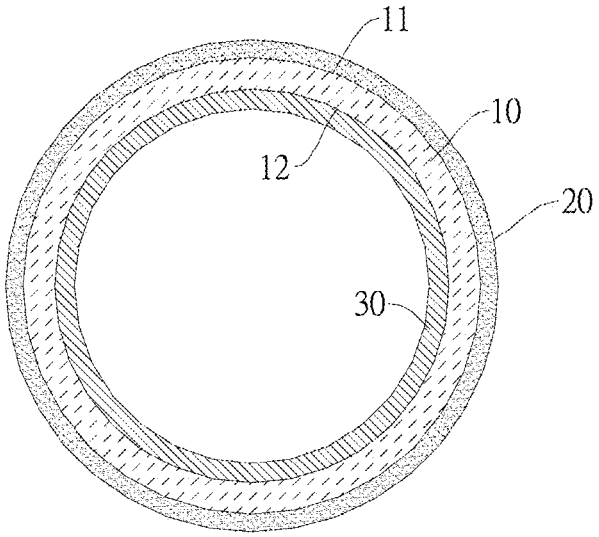
FIG. 1 is a schematic cross-sectional view of a preferred embodiment of the optical-film light tube in accordance with the present invention.
Figure 2:
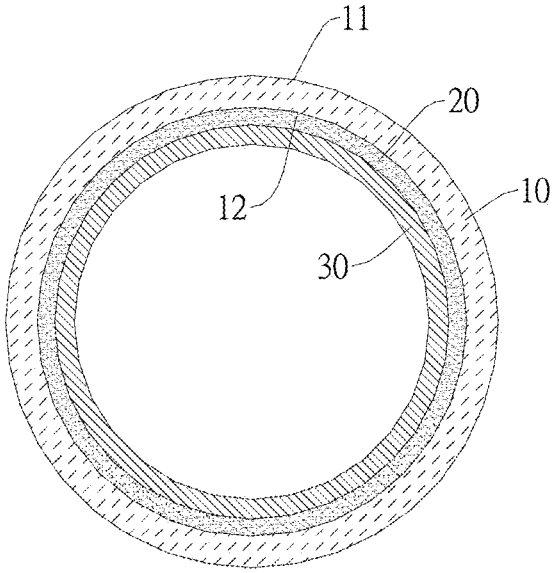
FIG. 2 is a schematic cross-sectional view of another embodiment of the optical-film light tube in accordance with the present invention.

Referring now to FIG. 1 and FIG. 2, schematic cross-sectional views of two embodiments of the optical-film light tube in accordance with the present invention are shown. Each of the two embodiments includes a transparent sealed body, an optical film 20 and a visible light layer 30. The transparent sealed body can be formed as a light tube 10, a longitudinal tube with a circular cross section. The light tube 10 has an exterior wall 11 and an interior wall 12 opposing to the exterior wall 11. On the light tube 10, the optical film 20 and the visible light layer 30 are coated to either the interior wall 12 or the exterior wall 11. In the embodiment shown in FIG. 1, the optical film 20 is coated to the exterior wall 11 of the light tube 10, while the visible light layer 30 is coated to the interior wall 12. In the embodiment shown in FIG. 2, the optical film 20 and the visible light layer 30 are coated in order to the interior wall 12 of the light tube 10.

Figure 3:
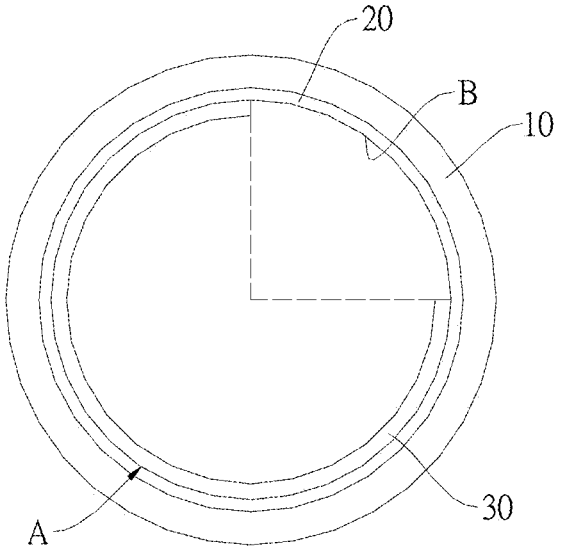
FIG. 3 is a schematic cross-sectional view to demonstrate an optical-film light tube in accordance with the present invention, in which a 270-degree visible light layer is coated on an interior optical film of the light tube.
Figure 4:
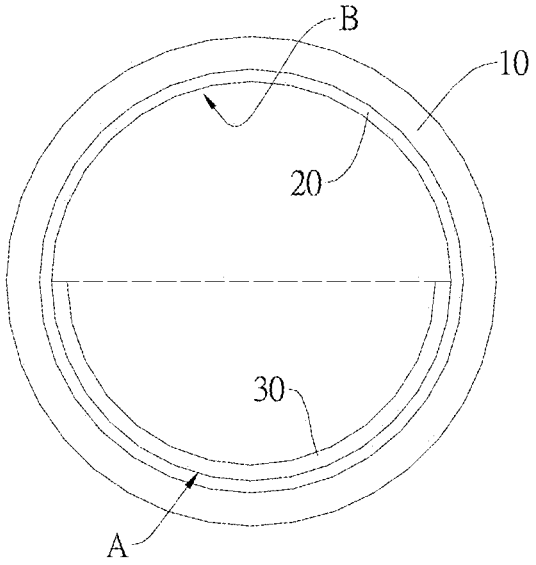
FIG. 4 is a schematic cross-sectional view to demonstrate an optical-film light tube in accordance with the present invention, in which a 180-degree visible light layer is coated on an interior optical film of the light tube.

In the present invention, the cross section of the longitudinal light tube 10 can also be a semi-circle, a trapezoid, a triangle, a rectangle, a square, an elliptical and any appropriate shape the like. By taking the optical-film light tube 10 of FIG. 2 as an example, the visible light layer 30 coated on the interior wall 12 of the light tube 10 can be layered over the whole circumference, in the cross-sectional view. However, as shown in FIG. 3, the visible light layer 30 can also be layered in a 270-degree range of the 360-degree circumference. Namely, it shows in FIG. 3 that the light tube 10 has a 270-degree coated area A and a 90-degree uncoated area B. In another embodiment shown in FIG. 4, the light tube 10 has a 180-degree coated area A and a 180-degree uncoated area B. Namely, each of the coated area A and uncoated area B occupies half of the circumference of the light tube 10. Also, it is understood that the side of the light tube 10 coated with the visible light layer 30 stands for the light-extraction portion of the light tube 10. Hence, any change in coating the visible light layer 30 provides a different choice upon the formation of the light-extraction to the light tube 10.

Figure 5:
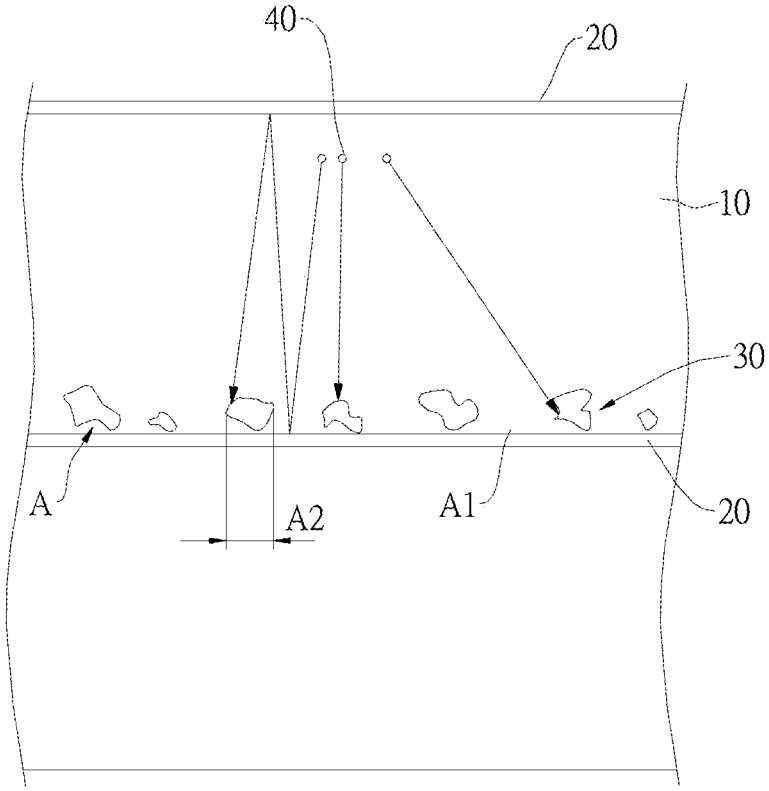
FIG. 5 illustrates schematically typical light extraction of the optical-film light tube in accordance with the present invention.

Referring now to FIG. 5, in the light tube 10, the visible light layer 30 is formed by a fluorescent or phosphorescent layer with particles coated onto the interior wall of the light tube 10. In the light tube 10, the coated area A is defined mainly on the particle layer of the visible light layer 30. In the visible light layer having particles (coated area A), there are spacings A1 formed between neighboring particles. The coverage A2 is defined to the occupation area of the particles in the visible light layer 30. As shown, the particles in the coated area A are presented to be distributed in a manner of sparse scattering coating. After the ultraviolet lights 40 are emitted, a portion of the ultraviolet light 40 can penetrate the visible light layer 30 through the spacings A1 to arrive at the optical film 20. The optical film 20 reflects part of the ultraviolet lights 40 to the other-side optical film 20. Again, the other-side optical film 20 reflects another part of the arriving ultraviolet lights 40 to the visible light layer 30; some to hit on the particles in the visible light layer while some to penetrate the visible light layer 30 through the spacings A1 and to be reflected by the optical film 20 again. If any ultraviolet light 40 hits and excites the particle in the visible light layer 30, then a corresponding visible light can be produced and released. The excited visible light may then penetrate the optical film 20 to form the light extraction of the light tube 10. Upon such an arrangement, the particles in the coated area can be efficiently projected to release the visible lights by the ultraviolet lights 40. Hence, the visible light layer 30 in accordance with the manner of sparse scattering coating can greatly reduce the usage of the fluorescent/phosphorescent material, and can obtain a higher brightness with respect to the same material usage.

In the embodiment as shown in FIG. 5, the particles in the visible light layer 30 are monolayered into a coating manner of sparse scattering. Typically, the granular sizes or the outer diameters of the particles are ranged from 1~2 μm to 50 μm, even up to 100 μm. The total area X of the spacings A1 is about 40% in area of the coated area A. The total area of the coverage A2 of all the particles is about 60% in area of the coated area A.

Figure 6:
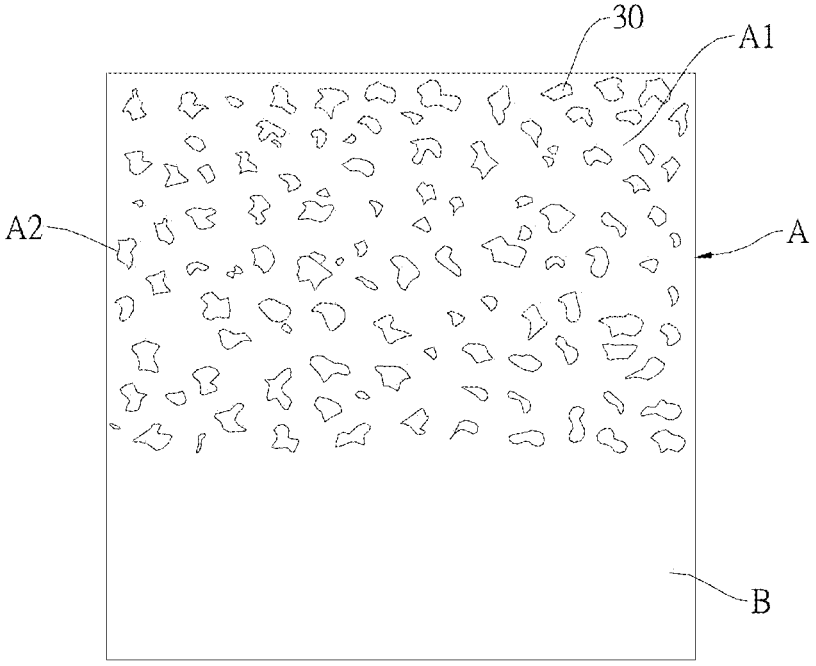
FIG. 6 illustrates schematically a scattering pattern of particles in the visible light layer in accordance with the present invention.

Referring now to FIG. 6, another embodiment of a light tube 10 having a coated area A f the visible light layer 30 is shown. In this embodiment, a portion of the wall of the light tube 10 is formed as an uncoated area B, while the coated area A presents the particles of the visible light layer 30 in a coating manner of monolayering, even distributed and sparse scattering. The total area X of the coverage X2 for the particles of the visible light layer 30 can be about 1% to 99% in area of the coated area A, preferably 30% to 80% in a preferred embodiment.

Figure 7:
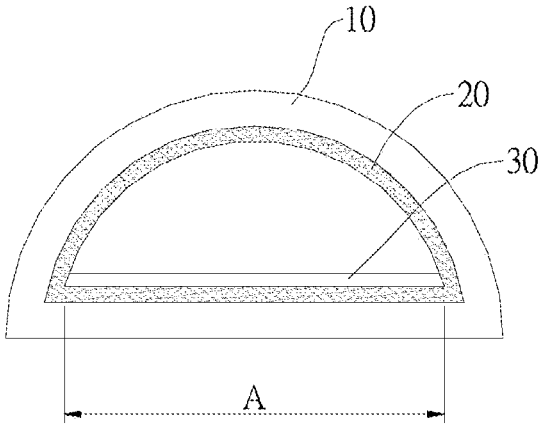
FIG. 7 shows schematically a cross-sectional of an embodiment of a semi-circular light tube in accordance with the present invention, in which the visible light layer is coated on an internal straight surface.
Figure 8:
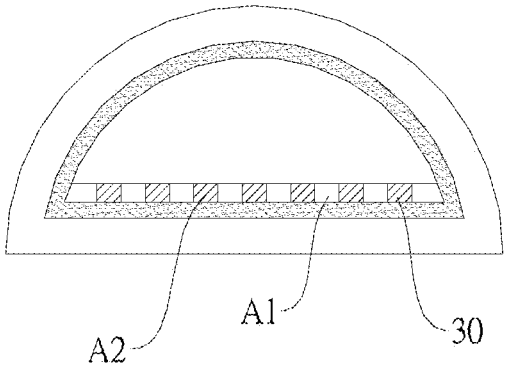
FIG. 8 shows schematically a cross-sectional of another embodiment of a semi-circular light tube in accordance with the present invention, in which the visible light layer is coated on an internal straight surface.

Referring now to FIG. 7, another embodiment of the light tube 10 having a hemi-circle cross section is shown. In thin embodiment, the cross section of the light tube 10 is structured by an arc portion and a straight wall. The optical film 20 is coated onto the interior wall of the longitudinal light tube 10. The coated area A coated as the visible light layer 30 is located inside and on the straight wall. Referring to FIG. 8, it is clearly shown that the particles of the visible light layer 30 are coated in a sparse scattering manner. Also, on the straight wall, coverage A2 for the particles and the coverage A1 for the spacings are included.

Figure 9:
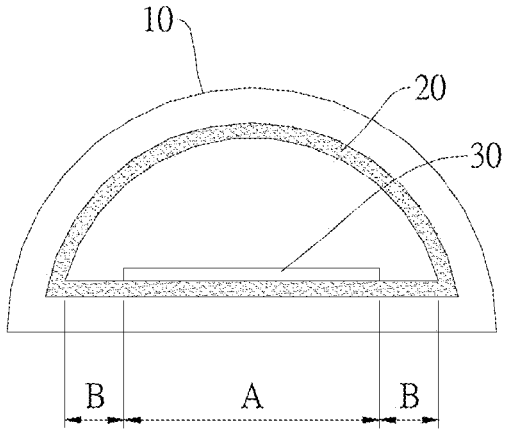
FIG. 9 shows schematically a cross-sectional of an embodiment of a semi-circular light tube in accordance with the present invention, in which an internal straight surface includes a coated area of the visible light layer and an uncoated area.
Figure 10:
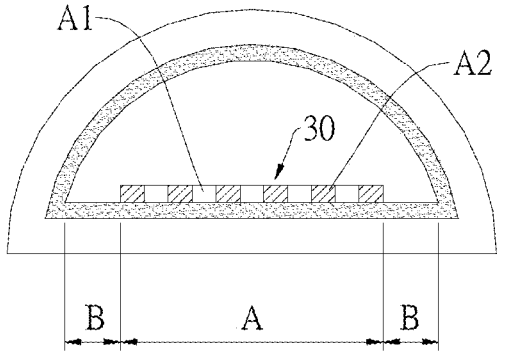
FIG. 10 shows schematically a cross-sectional of another embodiment of a semi-circular light tube in accordance with the present invention, in which an internal straight surface includes a coated area of the visible light layer and an uncoated area.

Referring now to FIG. 9, another embodiment of light tube 10 having a hemi-circle cross section is shown. it is shown on the straight wall that a coated area A and an uncoated area B are included. Further in FIG. 10, a predetermined area ratio for the particles of the visible light layer 30 to the coverage A2 of the coated area A is shown, while another ratio is also assigned to the inter-particle spacings A1.

For the embodiments from FIG. 7 to FIG. 10, the total area X of the coverage A2 for the particles in the coated area and the total area Y of the coverage for all inter-particle spacings A1 are clearly elucidated. In the following table, preferred ratio schemes upon the particle arrangement in the visible light layer 30 for various embodiments and for obtaining satisfied illumination performance are presented.

| Embodiment | X of A2 | Y of A1 |
|---|---|---|
| 1 | 99% > X ≥ 90% | 0% ≤ Y < 10% |
| 2 | 90% > X ≥ 80% | 10% ≤ Y < 20% |
| 3 | 80% > X ≥ 70% | 20% ≤ Y < 30% |
| 4 | 70% > X ≥ 60% | 30% ≤ Y < 40% |
| 5 | 60% > X ≥ 50% | 40% ≤ Y < 50% |

-continued

| Embodiment | X of A2 | Y of A1 |
|---|---|---|
| 6 | 50% > X ≥ 40% | 50% ≤ Y < 60% |
| 7 | 40% > X ≥ 30% | 60% ≤ Y < 70% |
| 8 | 30% > X ≥ 20% | 70% ≤ Y < 80% |
| 9 | 20% > X ≥ 1% | 80% ≤ Y < 99% |

Figure 11:
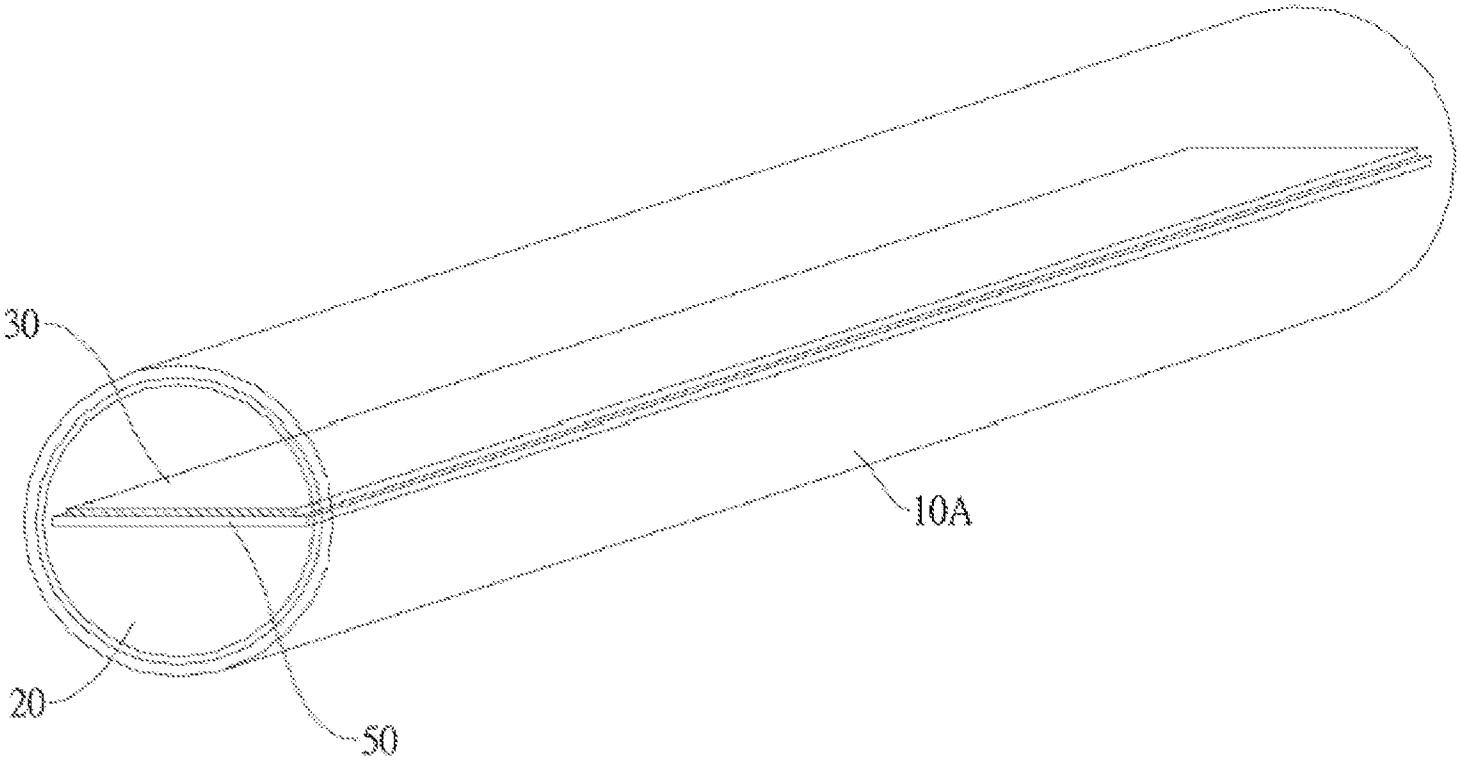
FIG. 11 is a schematic perspective view of an embodiment of the transparent sealed casing formed as a circular tube having an interior supporting member in accordance with the present invention.

Refer now to the embodiment shown in FIG. 11. The light-extraction apparatus for an optical-film lighting set having a visible-light coating includes a transparent sealed body, an optical film 20, a visible light layer 30 and a supporting member 50. The transparent sealed body is formed as a hollow light tube 10A having a circular cross section. The optical film 20 is coated onto an interior wall of the light tube 10A. The supporting member 50 located inside the light tube 10A is formed as a transparent plate with two opposing surfaces. On at least one surface of the supporting member 50, the visible light layer 30 in a coating manner of sparse scattering is coated.

Figure 13:
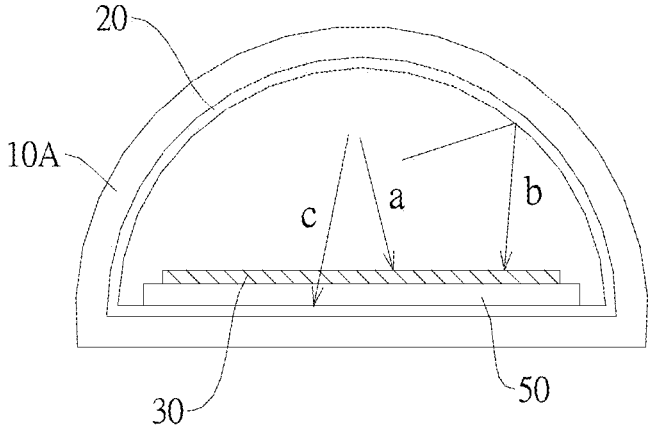
FIG. 13 is a schematic cross-sectional view of another embodiment of the transparent sealed casing formed as a semi-circular tube having an interior supporting member in accordance with the present invention, in which internal light trajectories are also typically shown.

Refers now to FIG. 13 for another embodiment of the light tubes 10A having a hemi-circle cross section consisting of a straight wall and an arc portion. The optical film 20 is coated inside onto the light tube 10A. The supporting member 50 is located on the straight wall inside the light tube 10A. The visible light layer 30 in a coating manner of sparse scattering is coated on the supporting member 50.

Figure 12:
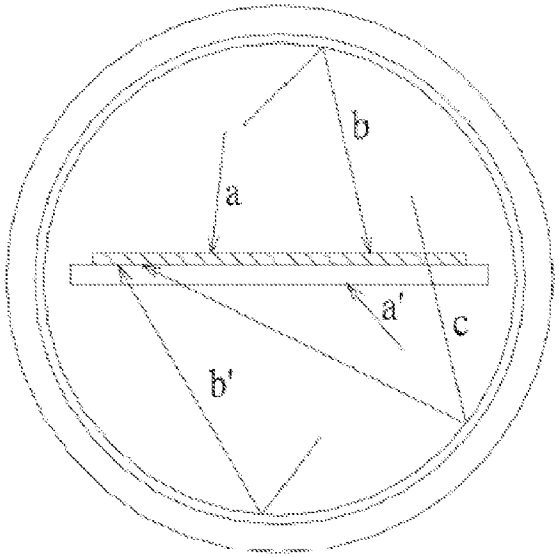
FIG. 12 demonstrates schematically light trajectories of the light source of FIG. 11.

Refers to both FIG. 12 and FIG. 13. While the light tube 10A is in application, the lights a and a' are directly projected onto the visible light layer 30 on the supporting member 50. The lights b and b' are firstly reflected by the optical film 20 and then sent to hit at the visible light layer 30 on the supporting member 50. The light c is to firstly penetrate the visible light layer 30 as well as the supporting member 50, then is reflected by the optical film 20, and finally hits the visible light layer 30 on the supporting member 50. Any of the aforesaid lights (ultraviolet lights) that hit the particle in the visible light layer 30 on the supporting member 50 can excite the particle efficiently to emit a corresponding visible light. By introducing the visible light layer 30 in a coating manner of sparse scattering according to the present invention, the usage in the fluorescent and/or phosphorescent material can be greatly reduced, and a comparable high brightness can be obtained.

Figure 14:
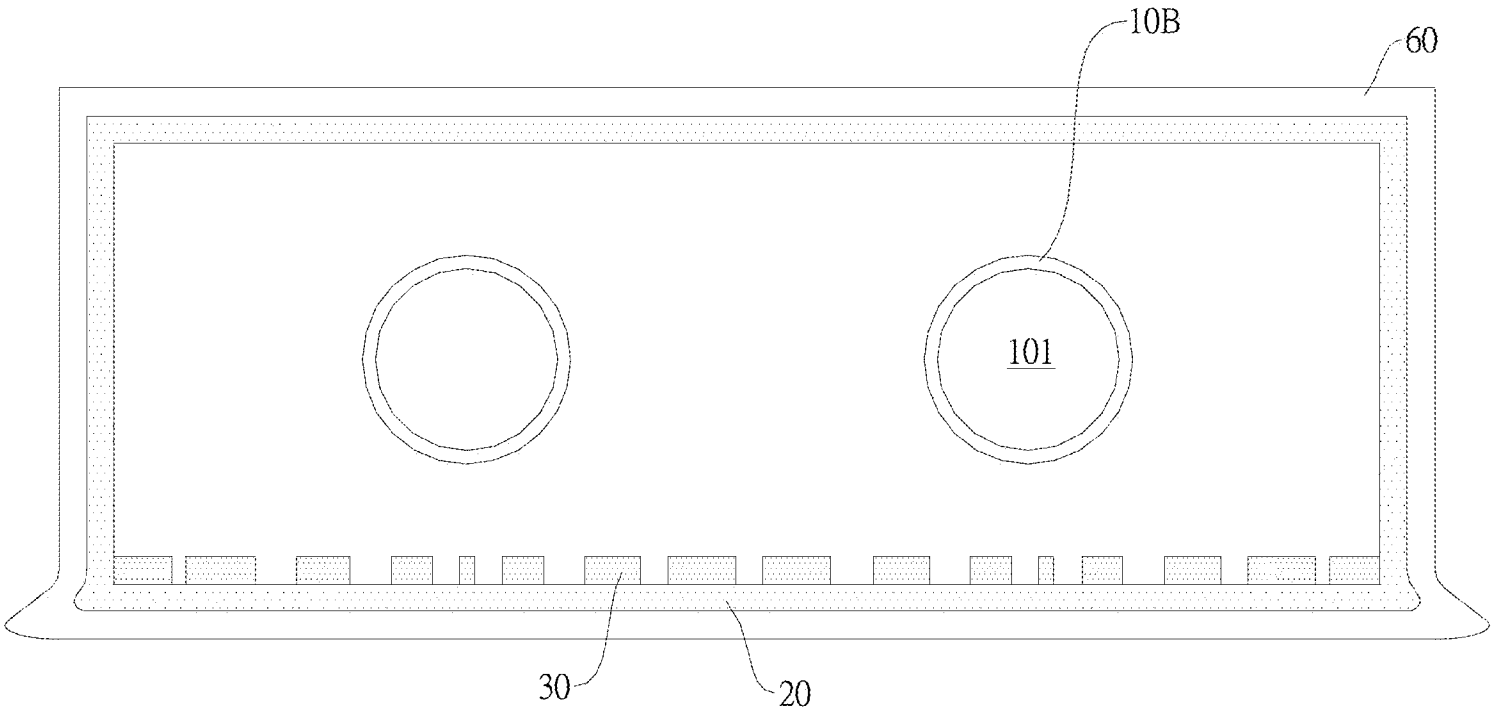
FIG. 14 shows schematically a cross-sectional view of an embodiment of the present invention that has the visible light layer coated onto an interior wall of a transparent sealed shell.

Referring now to FIG. 14, a further embodiment of the light-extraction apparatus in accordance with the present invention is shown in a schematically cross-sectional view. The apparatus includes a transparent sealed shield 60, a transparent sealed body, an optical film 20 and a visible light layer 30. The transparent sealed shield 60 is formed as a hollow thin-shell body having a rectangular cross section. On either the whole interior wall or the whole exterior wall of the transparent sealed shield 60, the optical film 20 is coated in a full coverage manner. Further, on a portion of the interior wall, the visible light layer 30 in a coating manner of sparse scattering is coated. The visible light layer 30 is consisted of the fluorescent particles or the phosphorescent particles arranged in a sparse-distributed pattern in the visible light layer 30. The transparent sealed body can be an ultraviolet light generator 10B having a discharging area to emit the ultraviolet lights. The ultraviolet lights inside the apparatus are projected onto the optical film 20 and the visible light layer 30.

Figure 15:
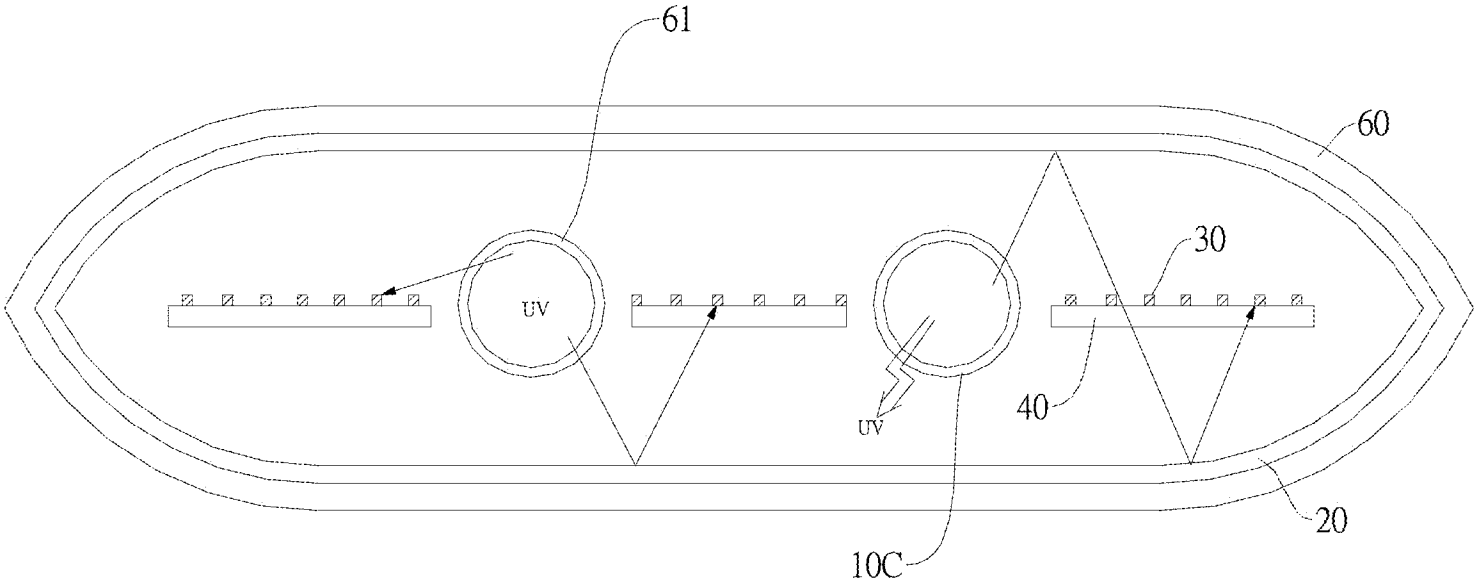
FIG. 15 shows schematically a cross-sectional view of another embodiment of the present invention that has the visible light layers coated onto internal supporting members of a transparent sealed shell.
Figure 16:
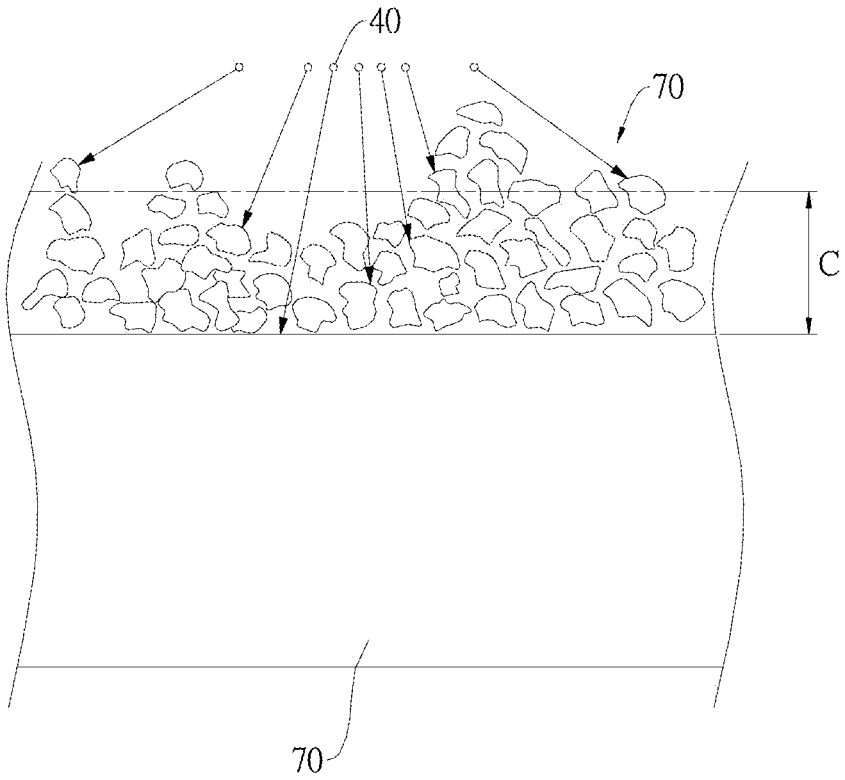
FIG. 16 (Prior art)
FIG. 16 is a schematic cross-sectional view of a conventional optical-film light tube.
Figure 17:
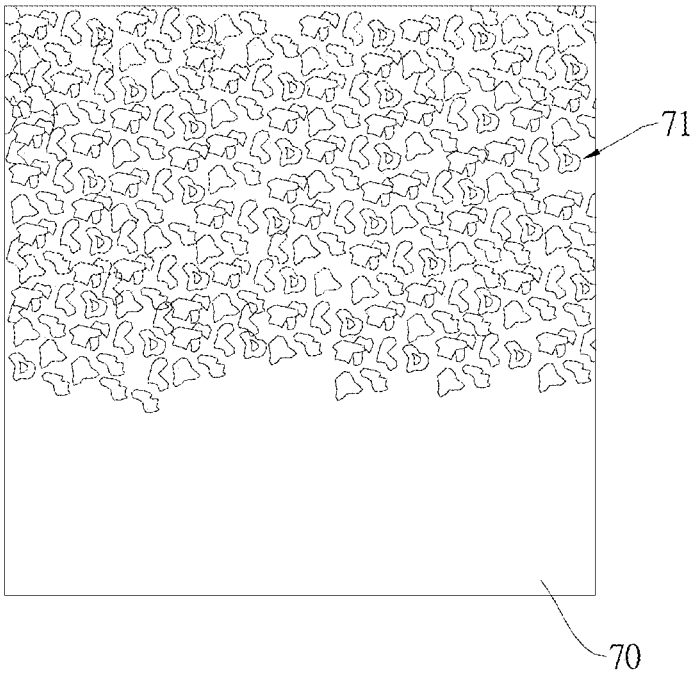
FIG. 17 shows schematically a multi-layered piling of particles in the visible light layer of a conventional optical-film light tube.

Referring now further to FIG. 15, one more embodiment of the light-extraction apparatus in accordance with the present invention is shown. In this embodiment, the transparent sealed shield 60 shaped as a hollow body further includes thereinside at least one supporting member 40 and at least another one secondary supporting member 61. The supporting member 40 can be a plate or a board, while the secondary supporting member 61 can be a tube or a sphere. The secondary supporting member 61 can be the platform to construct the ultraviolet light generator 10C, while the supporting member 40 can be used to be coated by the visible light layer 30. Further, the existence of the supporting member 40 and the secondary supporting member 61 can perform the reinforced structures for the shield 60. In addition, the optical film 20 can be coated in a full coverage manner onto either the interior wall or the exterior wall of the transparent sealed shield 60. The visible light layer 30 is coated onto the supporting member 40 in a sparse distributed manner. After the discharging area of the ultraviolet light generator 10C emits the ultraviolet lights, the ultraviolet lights are then projected onto the optical film 20 and the visible light layer 30. The shield 60 can perform as a reflection dome for reflecting the lights coming from the ultraviolet light generator 10C, the optical film 20 and the visible light layer 30, either in a refraction or focus manner.

Based on the aforesaid embodiments, following embodiments can be treated as derivative embodiments of the aforesaid embodiments. Hence, all these embodiments are mutually engageable or replaceable.

Figure 19:
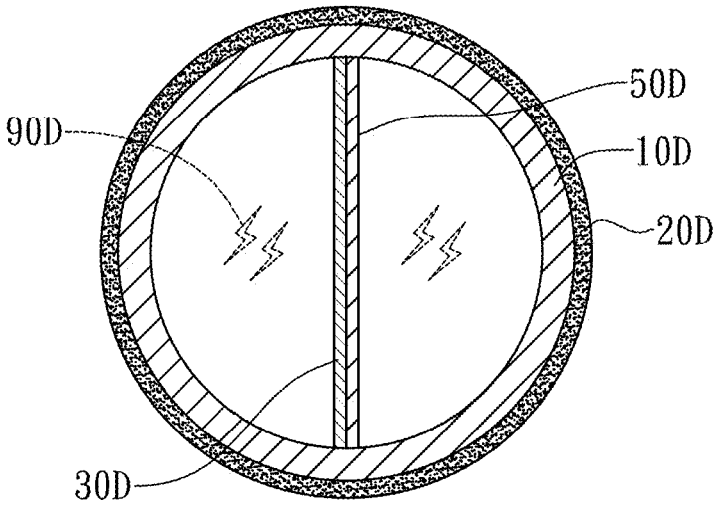
FIG. 19 also shows schematically of a cross-sectional view of one embodiment in accordance with the present invention.

Referring now to FIG. 19, one more further embodiment of the present invention is shown. The light-extraction apparatus in this embodiment includes a shell body 10D and at least one supporting member 50D. The supporting member 50D can be shaped as a plate, a board, sphere or a tube, and also can be existed in a single element or a set of plural elements. As shown, in this embodiment, the supporting member 50D is a plate located inside the shell body 10D. The optical film 20D is coated on the exterior wall of the shell body 10D, while the visible light layer 30D is coated on the supporting member 50D in the manner as described above. In the case that the supporting member 50D is to divide the internal space of the shell body 10D into a plurality of compartments, then it is preferably that each of the compartments can optionally have individual its own discharge gas 90D.

In the aforesaid embodiments and also the following embodiments, the material for producing the optical film can be one of or a combination of at least two of $AlF_3$, $Al_2O_3$, $BaF_2$, BeO, $BiF_3$, $CaF_2$, $DyF_2$, $GdF_3$, $HfO_2$, $HoF_3$, $LaF_3$, $La_2O_3$, LiF, $MgF_2$, MgO, NaF, $Na_3AlF_6$, $Na_5Al_3F_{14}$, $NdF_3$, $PbF_2$, $ScF_2$, $Si_3N_4$, $SiO_2$, $SrF_2$, $ThF_4$, $ThO_2$, $YF_3$, $Y_2O_3$, $YbF_3$, $Yb_2O_3$, $ZrO_2$ and $ZrO_3$.

The material for the film of the present invention needs to be a material with a high-class purity, such as a class of the 4N (99.99%), 4N5 (99.995%), or even 5N (99.999%).

The optical film is characterized in a wide AOI to reflect the ultraviolet light but to allow the visible light to penetrate therethrough, in which the wide AOI is ranged from 0~90 degrees or from 0~30+ degrees to 90 degrees of angle of reflection (AOR). The ultraviolet light with the specific wavelength of the electroluminescence gas has a wavelength selected from the group of a pair of (one of 253.7 nm±2 nm and 253.7 nm±2 nm, and 184.9 nm±2 nm) and another pair of (one of 147 nm±2 nm and 147 nm±2 nm, and 173 nm±2 nm).

As described above, a portion of a surface of the supporting member coated by the visible light layer is defined as a coated area (AS), a rest portion of the surface of the supporting member is defined as an uncoated area (BS), and the coated area (AS) occupies 1%~99% in area of the surface.

An integrated area (X1) of the granular coverage (AB) of the particles of the visible light layer is about 1%~99% of a total area of the coated area (AS), preferably 30% to 80%.

The integrated area of the granular coverage (AB) of the particles in the coated area (AS) is denoted as the X1, while the total area of the coverage for all inter-particle spacings AG is denoted as the YS. In the following table, preferred ratio schemes upon the particle arrangement in the visible light layer for various embodiments and for obtaining satisfied illumination performance are presented.

| Embodiment | X1 of AB | YS of AG |
|---|---|---|
| 1 | 99% > X1 ≥ 90% | 0% ≤ YS < 10% |
| 2 | 90% > X1 ≥ 80% | 10% ≤ YS < 20% |
| 3 | 80% > X1 ≥ 70% | 20% ≤ YS < 30% |
| 4 | 70% > X1 ≥ 60% | 30% ≤ YS < 40% |
| 5 | 60% > X1 ≥ 50% | 40% ≤ YS < 50% |
| 6 | 50% > X1 ≥ 40% | 50% ≤ YS < 60% |
| 7 | 40% > X1 ≥ 30% | 60% ≤ YS < 70% |
| 8 | 30% > X1 ≥ 20% | 70% ≤ YS < 80% |
| 9 | 20% > X1 ≥ 1% | 80% ≤ YS < 99% |

Figure 20:
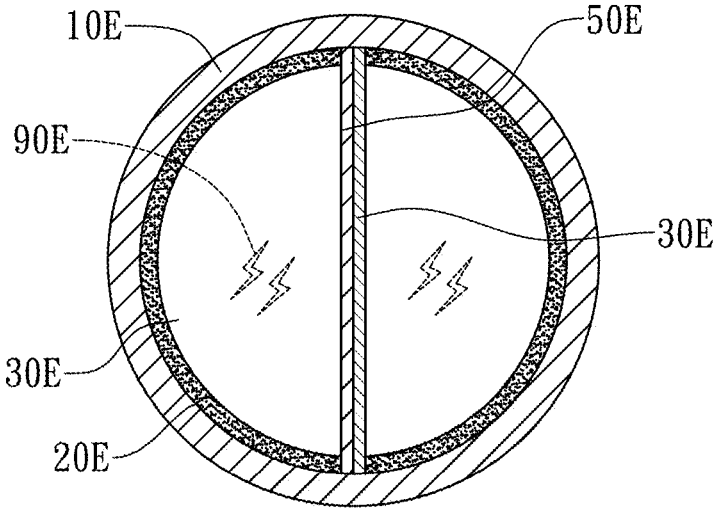
FIG. 20 also shows schematically of a cross-sectional view of one embodiment in accordance with the present invention.

Referring now to FIG. 20, another embodiment of the light-extraction apparatus in accordance with the present invention includes an optical film 20E coated onto the interior wall of the shell body 10E, at least one supporting member 50E constructed inside the shell body 10E. The at least one supporting member 50E is to divide the shell body 10E into a plurality of compartments. Each compartment may have its own discharge gas 90E. For an example having two compartments, two electrodes can be separately located to two individual compartments, but can be positioned at the same end of the light tube. However, the other end of the light tube is sealed but to provide a space communication between the two compartments, such that a vacuum plasma loop inside the light tube can be established.

Figure 21:
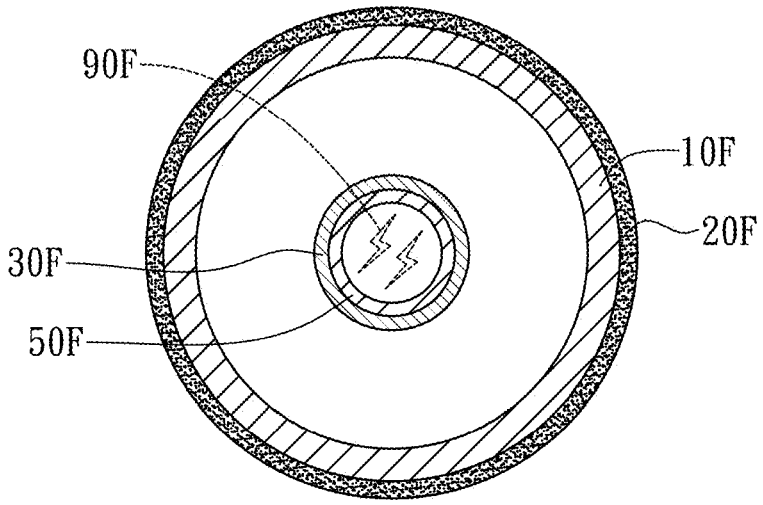
FIG. 21 also shows schematically of a cross-sectional view of one embodiment in accordance with the present invention.

Referring now to FIG. 21, the optical film 20F is coated onto the exterior wall of the shell body 10F. At least one supporting member 50F is located inside the shell body 10F. The supporting member 50F can be formed as a tube or a sphere. The visible light layer 30F is coated onto a lateral surface of the supporting member 50F so as to face the shell body 10F. The discharge gas 90F is filled inside the supporting member 50F.

Figure 22:
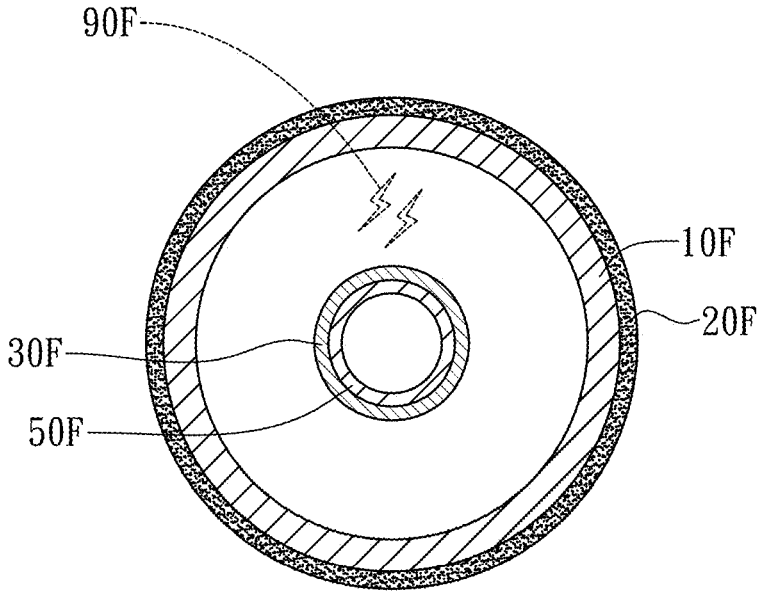
FIG. 22 also shows schematically of a cross-sectional view of one embodiment in accordance with the present invention.

Referring now to FIG. 22, a derivative of the embodiment of FIG. 21 is shown. In this embodiment, positions of the optical film 20F, the shell body 10F, the supporting member 50F and the visible light layer 30F are the same as those of FIG. 21. Yet, in this embodiment, the discharge gas 90F is filled between the supporting member 50F and the shell body 10F. The result formulation of the light tube of FIG. 22 is an induction lamp or an electrodeless lamp, in which the electromagnetic sensor is located inside the supporting member 50F.

Figure 23:
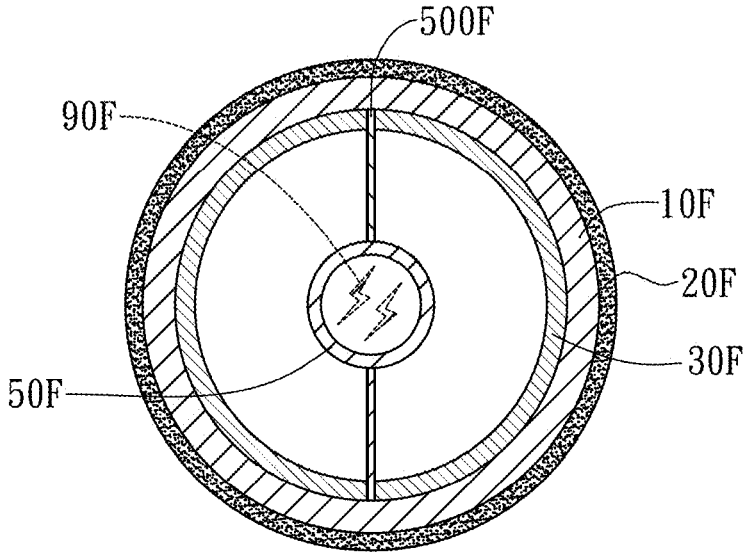
FIG. 23 also shows schematically of a cross-sectional view of one embodiment in accordance with the present invention.

Referring now to FIG. 23, at least one supporting member 50G is located inside the shell body 10G. The supporting member 50G can be a tube or a sphere. An optical film 20G is coated onto the exterior wall of the shell body 10G. A visible light layer 30G is coated onto the interior wall of the shell body 10G. At least an auxiliary supporting member 500G is located between the supporting member 50G and the shell body 10G. The auxiliary supporting member 500G formed as a plate or a board provides one end thereof connecting to the interior wall of the shell body 10G and another end thereof connecting to the exterior wall of the supporting member 50G 的 exterior wall. Also, At least one discharge gas 90G is filled inside the supporting member 50G.

Figure 24:
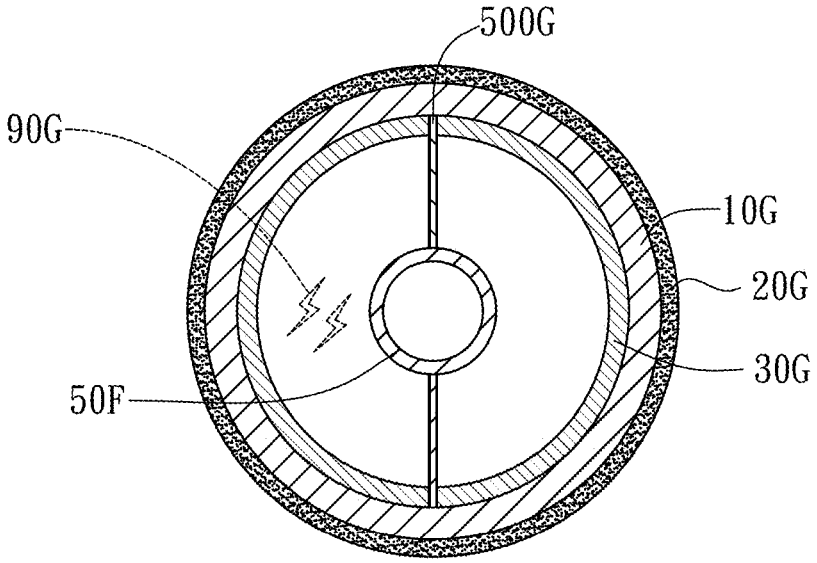
FIG. 24 also shows schematically of a cross-sectional view of one embodiment in accordance with the present invention.

Refer now to FIG. 24, a further derivative embodiment of the embodiment of FIG. 23 is shown. In this embodiment, the optical film 20G, the shell body 10G, the supporting member 50G and the visible light layer 30G are located to the same positions as those of the embodiment of FIG. 23. In this embodiment, the discharge gas 90G is filled to the space between the supporting member 50G and the shell body 10G. Of course, the visible light layer 30G can also be coated to one surface of the auxiliary supporting member 500G, not to the aforesaid interior wall of the shell body 10G. The aforesaid changes can prevail to all other embodiments of the present invention. The only requirement is that the material for the supporting member 500G free of the optical film shall allow the ultraviolet lights with a 184.9 nm wavelength and a 253.7 nm wavelength to penetrate.

Figure 25:
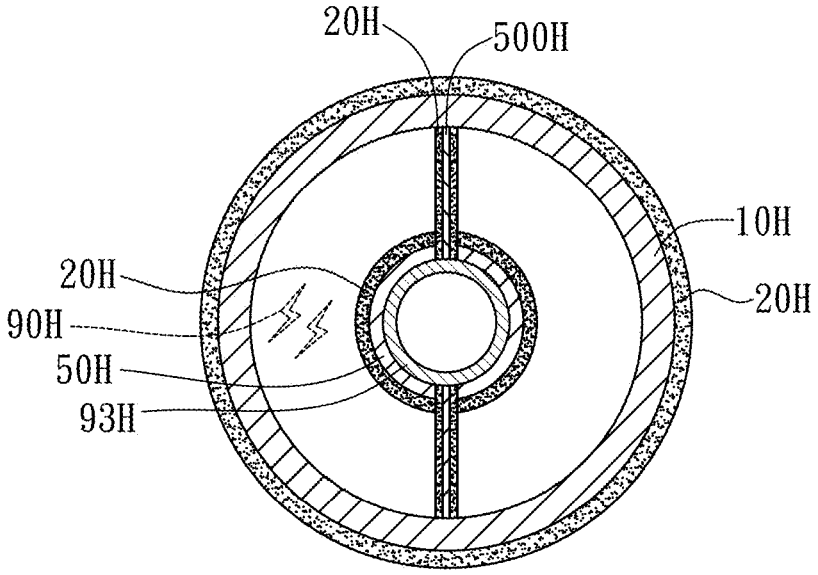
FIG. 25 also shows schematically of a cross-sectional view of one embodiment in accordance with the present invention.

Referring now to the embodiment shown in FIG. 25, an optical film 20H is coated onto the exterior wall of the shell body 10H, at least one supporting member 50H is located inside the shell body 10H, at least one auxiliary supporting member 500H is located between the shell body 10H and the supporting member 50H, another optical film 20H is coated to the exterior wall of the supporting member 50H, and at least one surface or two surface of the auxiliary supporting member 500H is free of the optical film 20H. Also, a reflective layer 93H is coated onto the interior wall of the supporting member 50H. The reflective layer 93H is made of a silver-aluminum material.

Figure 26:
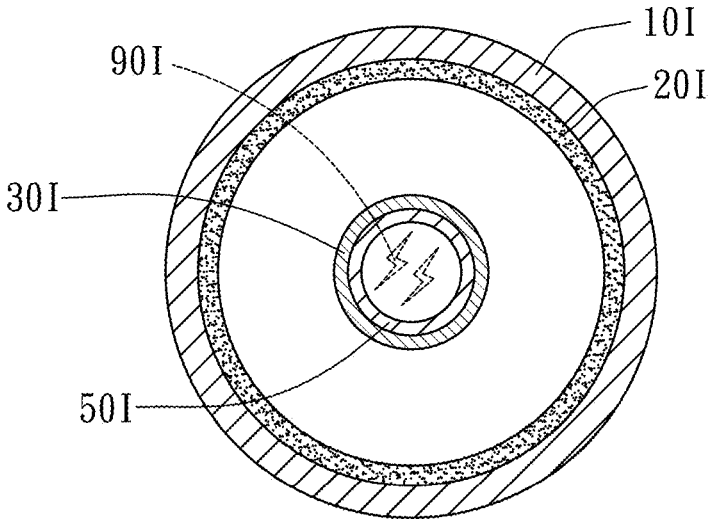
FIG. 26 also shows schematically of a cross-sectional view of one embodiment in accordance with the present invention.

Referring now to FIG. 26, it shown that an optical film 20I is coated onto the interior wall of the shell body 10I, a supporting member 50I is constructed inside the shell body 10I, the supporting member 50I can be a tube or a sphere, an optical film 20G is coated onto the exterior wall of the supporting member 50I, a visible light layer 30I is coated onto a surface of the optical film 20I that is positioned away from the supporting member 50I. The setup of the visible light layer 30I in this embodiment is the same as all those described above. In addition, a discharge gas 90I is filled inside the supporting member 50I.

Figure 27:
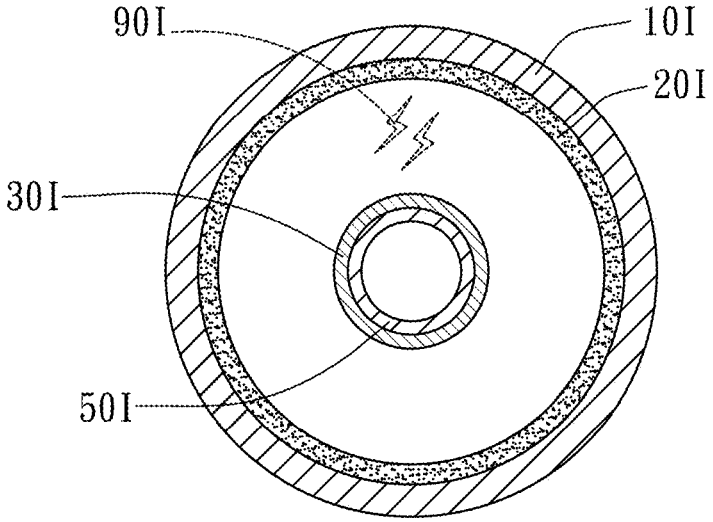
FIG. 27 also shows schematically of a cross-sectional view of one embodiment in accordance with the present invention.

Refer now to the embodiment shown in FIG. 27, which is a derivative of the embodiment of FIG. 26. It is shown in this embodiment that the locations of the optical film 20I, the shell body 10I, the supporting member 50I and the visible light layer 30I are all the same as those in FIG. 26. Yet, in this embodiment, the discharge gas 90I is filled in the space between the supporting member 50I and the shell body 10I.

Figure 28:
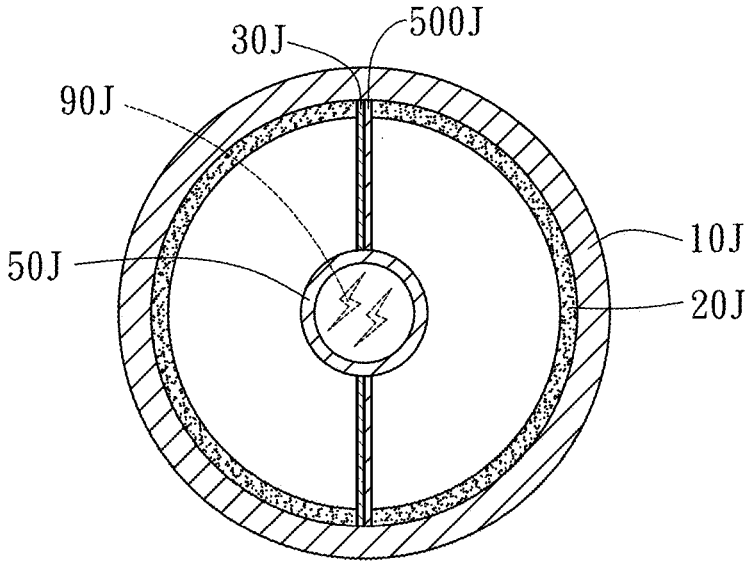
FIG. 28 also shows schematically of a cross-sectional view of one embodiment in accordance with the present invention.

Refer now to FIG. 28. In this embodiment, a supporting member 50J is constructed inside the shell body 10J, a discharge gas 90J is filled inside the supporting member 50J, at least one auxiliary supporting member 500J is located between the shell body 10J and the supporting member 50J, an optical film 20J is coated onto the interior wall of the shell body 10J, and a visible light layer 30J is coated onto at least one surface of the auxiliary supporting member 500J.

As described above, a portion of a surface of the supporting member coated by the visible light layer is defined as a coated area (AAS), a rest portion of the surface of the supporting member is defined as an uncoated area (BAS), and the coated area (AAS) occupies 1%~99% in area of the surface.

An integrated area (X2) of the granular coverage (AAB) of the particles of the visible light layer is about 1%~99% of a total area of the coated area (AAS), preferably 30% to 80%.

The integrated area of the granular coverage (AAB) of the particles in the coated area (AAS) is denoted as the X2, while the total area of the coverage for all inter-particle spacings AAG is denoted as the YAS. In the following table, preferred ratio schemes upon the particle arrangement in the visible light layer for various embodiments and for obtaining satisfied illumination performance are presented.

| Embodiment | X2 of AAB | YAS of AAG |
|---|---|---|
| 1 | 99% > X2 ≥ 90% | 0% ≤ YAS < 10% |
| 2 | 90% > X2 ≥ 80% | 10% ≤ YAS < 20% |
| 3 | 80% > X2 ≥ 70% | 20% ≤ YAS < 30% |
| 4 | 70% > X2 ≥ 60% | 30% ≤ YAS < 40% |
| 5 | 60% > X2 ≥ 50% | 40% ≤ YAS < 50% |
| 6 | 50% > X2 ≥ 40% | 50% ≤ YAS < 60% |
| 7 | 40% > X2 ≥ 30% | 60% ≤ YAS < 70% |
| 8 | 30% > X2 ≥ 20% | 70% ≤ YAS < 80% |
| 9 | 20% > X2 ≥ 1% | 80% ≤ YAS < 99% |

Figure 29:
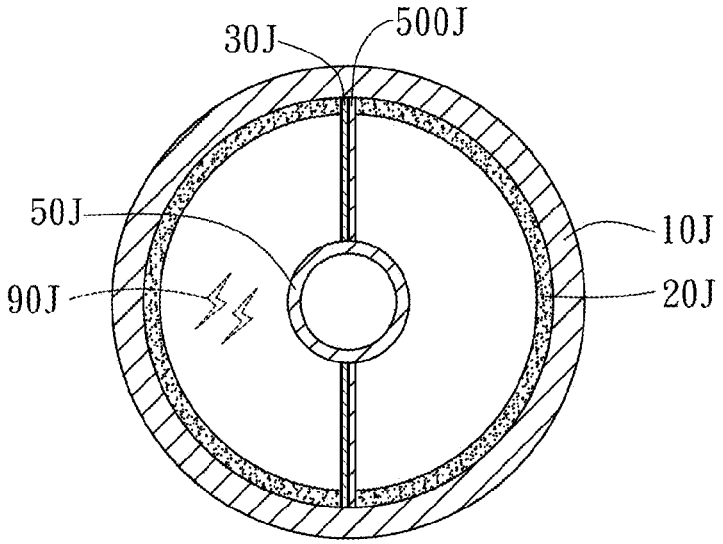
FIG. 29 also shows schematically of a cross-sectional view of one embodiment in accordance with the present invention.

Refer now to the embodiment shown in FIG. 28, which is a derivative of the embodiment of FIG. 28. As shown, in FIG. 29, the supporting member 50J, the auxiliary supporting member 500J, the optical film 20J, the shell body 10J and the visible light layer 30J are all setup in accordance with the teaching of the embodiment in FIG. 28. Yet, the discharge gas 90J is filled into the space between the shell body 10J and the supporting member 50J.

Figure 30:
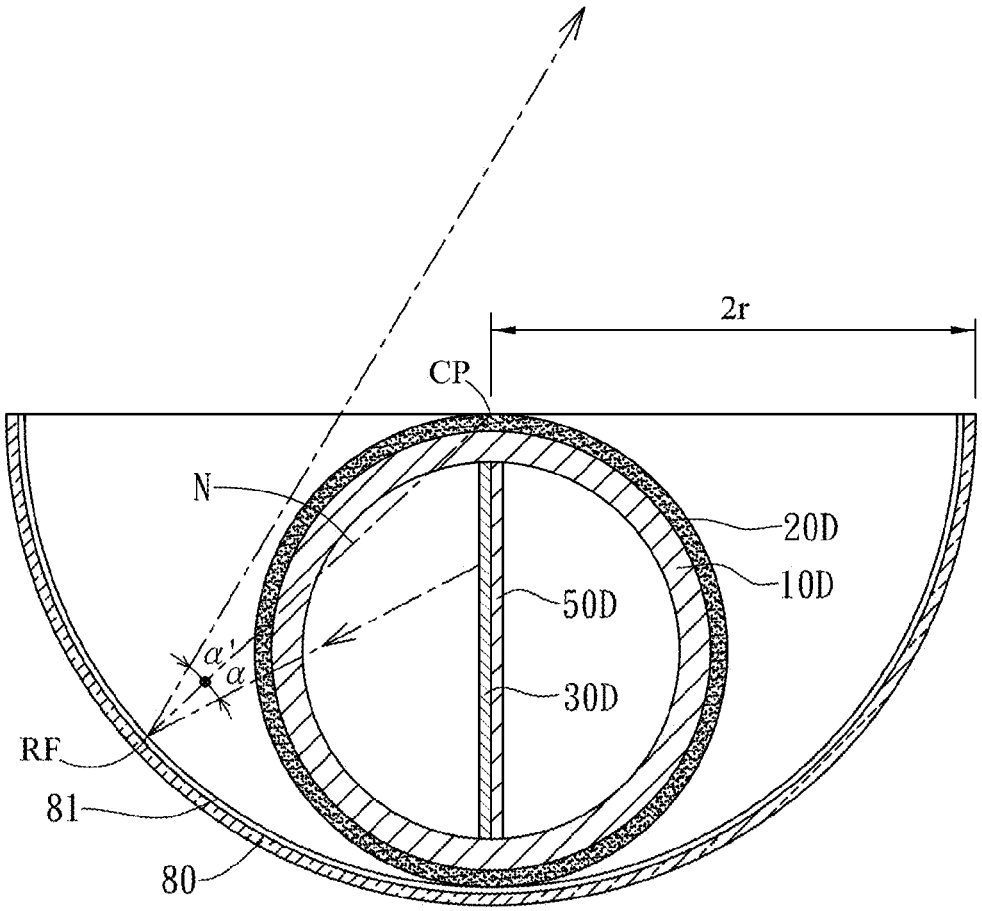
FIG. 30 also shows schematically of a cross-sectional view of one embodiment in accordance with the present invention.
Figure 31:
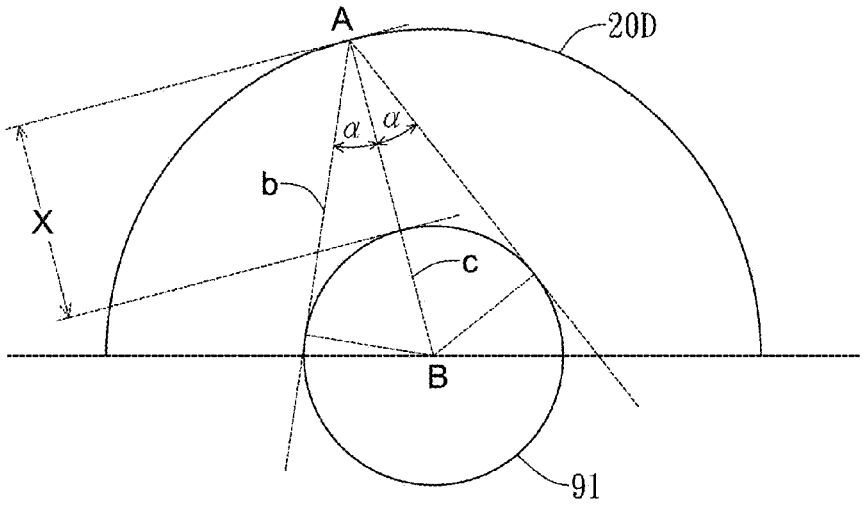
FIG. 31 demonstrates the relationship between the optical film and the light source in accordance with the present invention.
Figure 32:
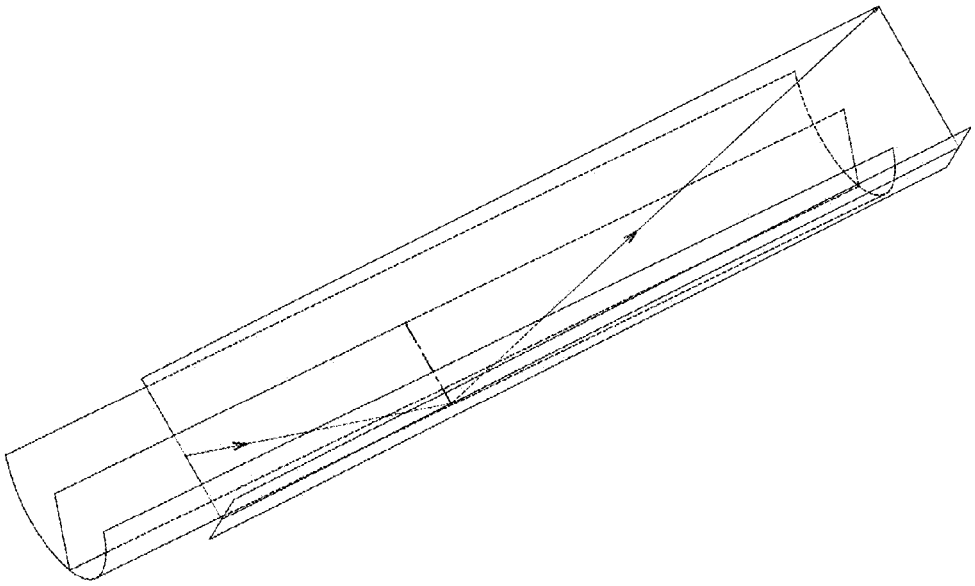
FIG. 32 shows schematically a perspective view of FIG. 32.

Referring now to FIG. 30, FIG. 31 and FIG. 32, another embodiment of the present invention is shown. In this embodiment, the shell body 10D, the optical film 20D, the visible light layer 30D and the supporting member 50D are all constructed according to the same manner of FIG. 19. In this embodiment, the shell body 10 is formed as a sphere, an illumination part 91 is located in a pseudo-sphere inside the shell body 10D, as shown in FIG. 31. The illumination part 91 and the shell body 10 are co-centrally related. The optical film 20D is coated onto the outside wall of the shell body 10D, or onto the inside wall of the shell body 10D. The illumination part 91 is to emit the ultraviolet lights or the blue lights. A distance c is defined to the distance between any point A on the optical film 20D and the center B of the illumination part 90. The line connecting A and B is the normal line of the AOR at point A. Point A to the projection of point A on the circumference of the illumination part 90 along a tangential line is measured to have a distance b. The radius of the illumination part is r. The AOI at point A is $\alpha$. Then, the distance c from the center B of the illumination part 90 to the point A should be greater or equal to $\csc\alpha \times r$, i.e., $c \geq \csc\alpha \times r$, for the $\alpha$ to be ranged from 0 degree to 60 degrees, preferably from 0 degree to 15 degrees.

Referring now to the embodiment shown in FIG. 31, the optical film 20D is coated to shield outside the illumination part 91 by a specific distance. A distance c is defined as the distance between an arbitrary point A on the optical film 20D and the center B of the illumination part 91. A distance b is defined as the distance between point A and the contact point at the illumination part 91 of a tangential light originated from point A to touch the circumference of the illumination part 91. The radius of the illumination part 91 is r. The AOI at point A is defined as an $\alpha$. Then, the distance c should be greater than or equal to $\csc \alpha \times r$, i.e. $c \geq \csc \alpha \times r$. Hence, as long as the distance c can be derived accordingly and also the illumination part 91 with a fixed r is predetermined, then the position relationship between the shell body 10D having the point A and the illumination part 91 having the center B can be decided. Namely, as shown in FIG. 31, the distance x between the point A and the illumination part 91 is derived by the equation $x=c-r$. For example, if the AOI $\alpha$ is ranged from 0 degree to 30 degrees, then $c=2r$ and $x=r$. Hence, though the AOR of the optical film 20D is not big enough, yet, due to the co-central relation between the illumination part 91 and the shell body 10, the optical film 20D can reflect the lights from the visible light layer 30D in the pseudo-sphere of the illumination part 91. The visible lights emitted from the visible light layer 30D can penetrate through the optical film 20D. But the ultraviolet lights would be reflected back to the visible light layer 30D for exciting the visible light layer 30D to emit the visible lights. Upon such an arrangement, the overall brightness can thus be elevated. Note this embodiment can also be applied to the apparatus which utilizes the blue-light LEDs to formulate the white-light LEDs, in which the LEDs are located inside the illumination part 91 (not shown in the figure).

According to the aforesaid description, the shell body 10D having the optical film 20D, the visible light layer 30D and the supporting member 50D can be positioned inside the reflection dome 80. The inner wall of the reflection dome 80 is coated with a reflective layer 81, which can be a reflective membrane or a silver-aluminum film. The reflection dome 80 can be formed as a portion of a sphere larger than a hemisphere. Namely, the largest depth inside the reflection dome 80 is no less than (i.e. larger than or equal to) its own radius. For example, if the diameter of the shell body 10D is r, then the radius of the reflection dome 80 is preferable to be 2r.

Refer now to FIG. 30 and FIG. 32, in which the visible light layer is a straight wall. If the visible light layer 30D coated on the supporting member 50D has a specific length, then a point RF is defined on the reflective layer 81 corresponding to the hitting point by a light reflected from the visible light layer 30. If the AOI of the point RF is an $\alpha$, and the AOR thereof is an $\alpha'$, then a normal line N from the center point CP of the reflection dome 80 to the point RF shall be ideally less than or equal to the radius 2r of the reflection dome 80. That is to say that the arc surface of the reflection dome 80 can be made larger, or at least equal to the length of the visible light layer 30D. Also, $\alpha'=\alpha'$ and the normal line N is larger than the length of the visible light layer 30D. Upon such an arrangement, the reflective lights won't reflect back to the visible light layer 30D. As shown in FIG. 32, if the single reflective light can be seen as a plurality of reflective lights, then these plural reflective lights won't be reflected back to the visible light layer 30D. Therefore, better illumination can be provided. That is to say that, if an extension plane of the visible light layer 30D is perpendicular to the center point of the arc of the reflective layer and the length of the visible light layer 30D is smaller than the radius of the reflection dome 80, then any extracted light from the straight wall coated with the visible light layer 30D would generate a reflection point RF at the reflection dome 80. Also, an angle is formed with the CP, such that the reflected light won't be reflected back to the CP. It is noted that the CP is already larger than the highest point of the visible light layer 30D. Hence, it is impossible that the light can be reflected to any point on the straight wall of the visible light layer 30D below the CP. Upon such an arrangement, the target of the present invention to avoid the extracted light to be reflected back to the visible light layer itself is then smartly achieved.

Figure 33:
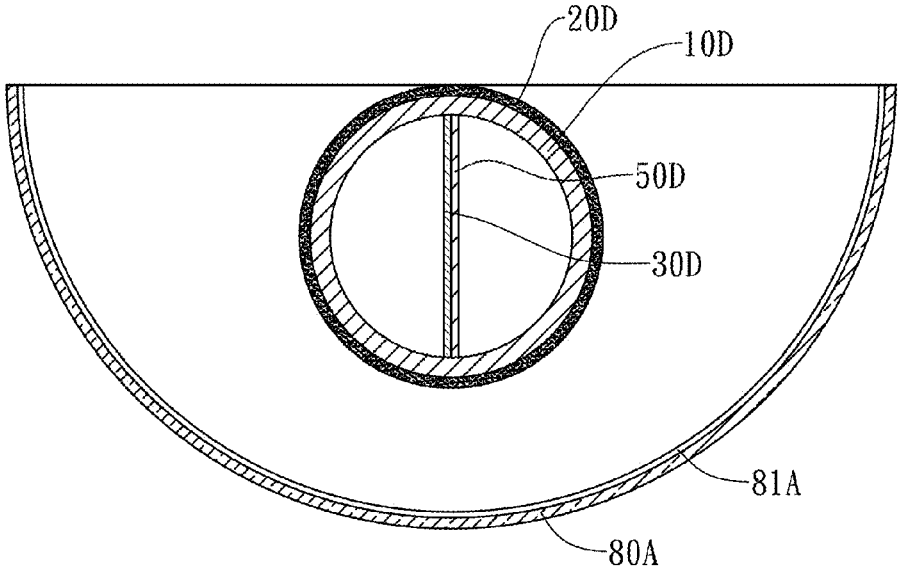
FIG. 33 also shows schematically of a cross-sectional view of one embodiment in accordance with the present invention.

Refer now to the embodiment shown in FIG. 33, which is a derivative of the foregoing embodiment. In this embodiment, the shell body 10D, the optical film 20D, the visible light layer 30D and the supporting member 50D are arranged in accordance with those shown in FIG. 19. Details toward these arrangements are already described in the previous section, and thus would be omitted herein. The shell body 10D having the optical film 20D, the visible light layer 30D and the supporting member 50D can be built inside the reflection dome 80A. The bottom of the shell body 10D is not contacted with the bottom of the reflection dome 80A. Also, the inner wall of the reflection dome 80A is coated with a reflective layer 81A.

Figure 34:
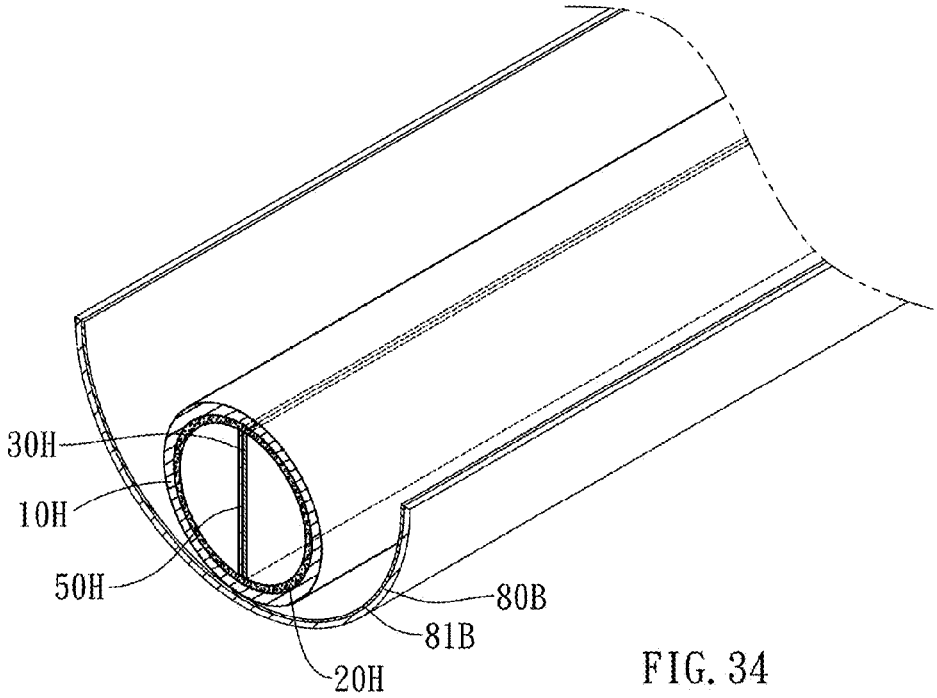
FIG. 34 also shows schematically of a cross-sectional view of one embodiment in accordance with the present invention.

Refer now to the embodiment shown in FIG. 34, which is a derivative of the embodiment shown in FIG. 11, and FIG. 19 through FIG. 22. In this embodiment, the shell body 10H is shown to be a light tube, the optical film 20H is coated onto the interior wall of the shell body 10H, the supporting member 50H is located inside the shell body 10H, the visible light layer 30H is optionally coated onto a surface of the supporting member 50H. As shown in FIG. 32 and FIG. 33, in this embodiment, the reflection dome 80B is to provide a platform for constructing the shell body 10H. The reflective layer 81B on the interior wall of the reflection dome 80B can be made of a dielectric reflective membrane or a silver-aluminum film. As shown in FIG. 32, a perspective view of FIG. 30, the reflection dome 80B is a hemi-circle tube parallel to the shell body 10H. Thereby, while the visible light layer 30H is at the light-extraction stage, the reflective lights from the reflective layer 81B won't pass the visible light layer 30H again.

Figure 35:
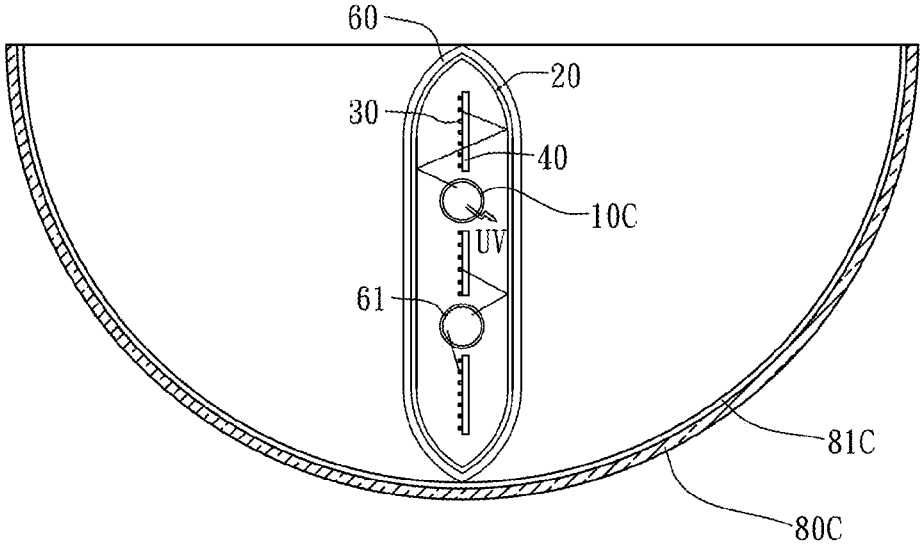
FIG. 35 also shows schematically of a cross-sectional view of one embodiment in accordance with the present invention.

Refer now to the embodiment shown in FIG. 35, which is a derivative of the embodiment shown in FIG. 15. In this embodiment, the shield 60, the supporting member 40, the supporting member 61, the visible light layer 30 and the ultraviolet light generator 10C are arranged according to the same pattern as shown in FIG. 15. In this embodiment, the shield 60 is performed as a shell body, the reflection dome 80C is to include the shield 60, and the interior wall of the reflection dome 80C is coated by a reflective layer 81C.

Figure 36:
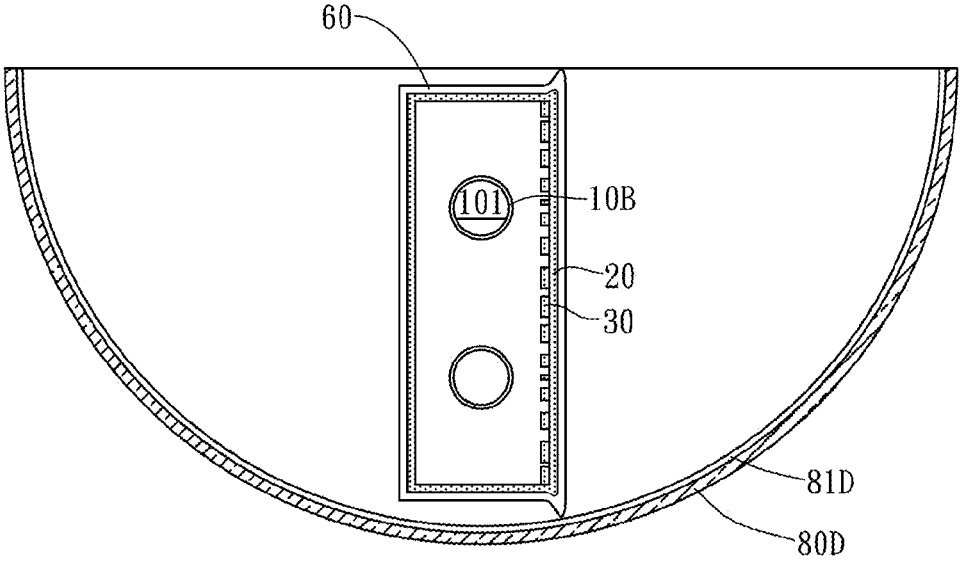
FIG. 36 also shows schematically of a cross-sectional view of one embodiment in accordance with the present invention.

Refer now to the embodiment shown in FIG. 36, which is a derivative of the embodiment shown in FIG. 14. In this embodiment, the shield 60, the optical film 20, the visible light layer 30 and the ultraviolet light generator 10B are arranged according to FIG. 14. Also, the shield 60 of this embodiment is treated as a shell body, the reflection dome 80D is there for constructing the shield 60, and the interior wall of the reflection dome 80D is coated by a reflective layer 81D. As described above, the setup of the visible light layer 30 in either FIG. 35 or FIG. 36 are the same as all the foregoing embodiments.

While the present invention has been particularly shown and described with reference to a preferred embodiment, it will be understood by those skilled in the art that various changes in form and detail may be without departing from the spirit and scope of the present invention.

What is claimed is:

1. A light-extraction apparatus for an optical-film lighting set having a visible-light coating, comprising:

a transparent sealed shell formed as a hollow pipe structure;

an optical film, coated onto the hollow pipe structure to omnidirectionally reflect ultraviolet lights for an angle of incidence ranged from 0 to 90 degrees but to allow visible lights to penetrate therethrough; and a visible light layer, wherein a surface of said hollow pipe structure includes a coated area coated by said visible light layer and the rest of the surface other than the coated area is defined as an uncoated area, the coated area occupies 1% to 99% of the surface, said visible light layer coated in a scattering manner onto the hollow pipe structure, having one of fluorescent particles and phosphorescent particles, wherein the fluorescent particles or phosphorescent particles are sparsely scattered in a predetermined distributed density, arranged as a monolayer coating, wherein 1%~99% of a total area of said coated area is an integrated area of the granular coverage of said one of fluorescent particles and phosphorescent articles of said visible light layer, and the rest of said total area is contributed by integrating areas for inter-particle spacings.

2. The light-extraction apparatus for an optical-film lighting set having a visible-light coating according to claim 1, wherein said hollow pipe structure has an exterior wall coated with said optical film and an interior wall opposing to the exterior wall and coated with said visible light layer.

3. The light-extraction apparatus for an optical-film lighting set having a visible-light coating according to claim 1, wherein said hollow pipe structure has an exterior wall and an interior wall opposing to the exterior wall, wherein the interior wall is laminated by said optical film and said visible light layer.

4. The light-extraction apparatus for an optical-film lighting set having a visible-light coating according to claim 3, wherein said interior wall of said hollow pipe structure includes a coated area (A) coated by said visible light layer and the rest of said interior wall other than the coated area (A) is defined as an uncoated area (B), wherein the coated area (A) occupies 1%~99% in area of said interior wall.

5. The light-extraction apparatus for an optical-film lighting set having a visible-light coating according to claim 1, wherein the fluorescent particles or phosphorescent particles have granular sizes ranged from 2 μm to 15 μm.

6. The light-extraction apparatus for an optical-film lighting set having a visible-light coating according to claim 1, wherein ranges for said X and said Y are formed as a pair selected from one of combinations: (99%>X≥90%, 0%≤Y<10%), (90%>X≥80%, 10%≥Y<20%), (80%>X≥70%, 20%≤Y<30%), (70%>X≥60%, 30%≤Y<40%), (60%>X≥50%, 40%≤Y<50%), (50%>X≥40%, 50%≤Y<60%), (40%>X≥30%, 60%≤Y<70%), (30%>X≥20%, 70%≤Y<80%), and (20%>X≤1%, 80%≤Y<99%).

7. A light-extraction apparatus for an optical-film lighting set having a visible-light coating, comprising:

a transparent sealed shell formed as a hollow pipe structure;

an optical film, coated onto the hollow pipe structure to omnidirectionally reflect ultraviolet lights for an angle of reflection ranged from 0~30+ degrees to 90 degrees but to allow visible lights to penetrate therethrough; and a visible light layer, wherein said wall of said hollow pipe structure includes a coated area coated by said visible light layer and the rest of said wall other than the coated area is defined as an uncoated area, wherein the coated area occupies 1%~99% of said wall, said visible light layer coated in a scattering manner onto the hollow pipe structure, having one of fluorescent particles and phosphorescent particles, wherein the one of fluorescent particles and phosphorescent particles are sparsely scattered on a wall of the hollow pipe structure in a predetermined distributed density, arranged as a monolayer coating, wherein 1%~99% of a total area of said coated area is an integrated area of the granular coverage of said one of fluorescent particles and phosphorescent articles of said visible light layer, and the rest of said total area is contributed by integrating areas for inter-particle spacings.

8. The light-extraction apparatus for an optical-film lighting set having a visible-light coating according to claim 7, wherein said hollow pipe structure has an exterior wall coated with said optical film and an interior wall opposing to the exterior wall and coated with said visible light layer.

9. The light-extraction apparatus for an optical-film lighting set having a visible-light coating according to claim 7, wherein said hollow pipe structure has an exterior wall and an interior wall opposing to the exterior wall, wherein the interior wall is laminated by said optical film and said visible light layer.

10. The light-extraction apparatus for an optical-film lighting set having a visible-light coating according to claim 9, wherein said interior wall of said hollow pipe structure includes a coated area (A) coated by said visible light layer and the rest of said interior wall other than the coated area (A) is defined as an uncoated area (B), wherein the coated area (A) occupies 1%~99% in area of said interior wall.

11. The light-extraction apparatus for an optical-film lighting set having a visible-light coating according to claim 7, wherein the fluorescent particles or phosphorescent particles have granular sizes ranged from 2 μm to 15 μm.

12. The light-extraction apparatus for an optical-film lighting set having a visible-light coating according to claim 7, wherein ranges for said X and said Y are formed as a pair selected from one of combinations: (99%>X≤90%, 0%≤Y<10%), (90%>X≤80%, 10%≤Y<20%), (80%>X≥70%, 20%≤Y<30%), (70%>X≥60%, 30%≤Y<40%), (60%>X≥50%, 40%≤Y<50%), (50%>X≥40%, 50%≤Y<60%), (40%>X≥30%, 60%≤Y<70%), (30%>X≥20%, 70%≤Y<80%), and (20%>X≥1%, 80%≤Y<99%).

13. A light-extraction apparatus for an optical-film lighting set having a visible-light coating, comprising:

a shell body;

an optical film coated inside the shell body;

a visible light layer, consisted of one of fluorescent particles and phosphorescent particles, the one of fluorescent particles and phosphorescent particles being coated onto the shell body in a predetermined scattering manner;

at least one supporting member, mounted inside the shell body and an ultraviolet light source for emitting, in an electroluminescence way, ultraviolet lights having a wavelength combination selected from the group of a pair of (one of 253.7 nm±2 nm and 253.7 nm±2 nm, and 184.9 nm±2 nm) and another pair of (one of 147 nm±2 nm and 147 nm±2 nm, and 173 nm±2 nm).

14. The light-extraction apparatus for an optical-film lighting set having a visible-light coating according to claim 13, wherein said optical film is characterized in a wide angle of incidence to reflect at least one specific ultraviolet light but to allow visible lights to penetrate therethrough, the wide angle of incident being ranged from 0~90 degrees or from 0~30+ degrees to 90 degrees of reflective angles.

15. The light-extraction apparatus for an optical-film lighting set having a visible-light coating according to claim 13, wherein a material of said optical film is selected from one of $AlF_3$, $Al_2O_3$, $BaF_2$, BeO, $BiF_3$, $CaF_2$, $DyF_2$, $GdF_3$, $HfO_2$, $HoF_3$, $LaF_3$, $La_2O_3$, LiF, $MgF_2$, MgO, NaF, $Na_3AlF_6$, $Na_5Al_3F_{14}$, $NdF_3$, $PbF_2$, $ScF_2$, $Si_3N_4$, $SiO_2$, $SrF_2$, $ThF_4$, $ThO_2$, $YF_3$, $Y_2O_3$, $YbF_3$, $Yb_2O_3$, $ZrO_2$, $ZrO_3$, and a combination of $ZrO_2$ and $ZrO_3$.

16. The light-extraction apparatus for an optical-film lighting set having a visible-light coating according to claim 13, wherein said shell body has an exterior wall coated with said optical film and an interior wall opposing to the exterior wall and coated with said visible light layer, or wherein said shell body has an interior wall and both said optical film and said visible light layer are laminated onto the interior wall.

17. The light-extraction apparatus for an optical-film lighting set having a visible-light coating according to claim 16, wherein a wall of said shell body includes a coated area (A)

coated by said visible light layer and the rest of the wall other than the coated area (A) is defined as an uncoated area (B), wherein the coated area (A) occupies 1%~99% of the wall.

18. The light-extraction apparatus for an optical-film lighting set having a visible-light coating according to claim 16, wherein said interior wall of said shell body includes a coated area (A) coated by said visible light layer and the rest of said interior wall other than the coated area (A) is defined as an uncoated area (B), wherein the coated area (A) occupies 1%~99% of said interior wall.

19. The light-extraction apparatus for an optical-film lighting set having a visible-light coating according to claim 17, wherein said one of fluorescent particles and phosphorescent particles in said coated area (A) are coated in a scattering manner.

20. The light-extraction apparatus for an optical-film lighting set having a visible-light coating according to claim 19, wherein said one of fluorescent particles and phosphorescent particles in said scattering manner are arranged in a form of monolayer coating and have granular sizes ranged from 1 μm to 100 μm.

21. The light-extraction apparatus for an optical-film lighting set having a visible-light coating according to claim 19, wherein 1%~99% of a total area of said coated area (A) is an integrated area (X) of the granular coverage (A2) of said one of fluorescent particles and phosphorescent particles of said visible light layer, and the rest (Y) of said total area is contributed by integrating areas for inter-particle spacings (A1).

22. The light-extraction apparatus for an optical-film lighting set having a visible-light coating according to claim 21, wherein ranges for said X and said Y are formed as a pair selected from one of combinations: (99%>X≥90%, 0%≤Y<10%), (90%>X≥80%, 10%≤Y<20%), (80%>X≤70%, 20%≤Y<30%), (70%>X≤60%, 30%≤Y<40%), (60%>X≤50%, 40%≤Y<50%), (50%>X≥40%, 50%≤Y<60%), (40%>X≤30%, 60%≤Y<70%), (30%>X≤20%, 70%≤Y<80%), and (20%>X≤1%, 80%≤Y<99%).

23. The light-extraction apparatus for an optical-film lighting set having a visible-light coating according to claim 13, wherein said shell body is mounted inside a reflective dome having an interior dome surface coated with a reflective layer.

24. The light-extraction apparatus for an optical-film lighting set having a visible-light coating according to claim 23, wherein said reflective layer is one of a dielectric reflective membrane and a silver-aluminum film, and said reflective dome is formed to have a volume larger than a hemisphere (i.e. having a maximum depth larger than a radius of the hemisphere).

25. The light-extraction apparatus for an optical-film lighting set having a visible-light coating according to claim 13, wherein said shell body further includes an illumination part.

26. The light-extraction apparatus for an optical-film lighting set having a visible-light coating according to claim 25, wherein said illumination part is one of an ultraviolet light source and a blue light source.

27. The light-extraction apparatus for an optical-film lighting set having a visible-light coating according to claim 25, wherein a distance between an arbitrary point A on said optical film and a center point B of said illumination part is defined as a c, a normal line for a reflective angle at the point A is the line connecting the point A and the point B, a distance between the point A and a tangential point at a rim of said illumination part with respect to the point A is defined as a b, the radius of said illumination part is defined as an r, an angle of incidence at the point A is define as an α, and then $c \leq \csc\alpha \times r$.

28. The light-extraction apparatus for an optical-film lighting set having a visible-light coating according to claim 27, wherein said angle of incidence α is ranged from 0 to 60 degrees.

29. The light-extraction apparatus for an optical-film lighting set having a visible-light coating according to claim 13, wherein said optical film is coated onto one of an interior wall and an exterior wall of said body shell, and said visible light layer is coated to said at least one supporting member.

30. The light-extraction apparatus for an optical-film lighting set having a visible-light coating according to claim 29, wherein a portion of a surface of said at least one supporting member coated by said visible light layer is defined as a coated area (AS), a rest portion of the surface of said at least one supporting member is defined as an uncoated area (BS), and the coated area (AS) occupies 1%~99% in area of the surface.

31. The light-extraction apparatus for an optical-film lighting set having a visible-light coating according to claim 30, wherein said one of fluorescent particles and phosphorescent particles in said coated area are coated in a scattering manner.

32. The light-extraction apparatus for an optical-film lighting set having a visible-light coating according to claim 31, wherein said one of fluorescent particles and phosphorescent particles in said scattering manner are arranged in a form of monolayer coating and have granular sizes ranged from 1 μm to 100 μm.

33. The light-extraction apparatus for an optical-film lighting set having a visible-light coating according to claim 30, wherein 1%-99% of a total area of said coated area (AS) is an integrated area (X1) of the granular coverage (AB) of said one of fluorescent particles and phosphorescent particles of said visible light layer, and the rest (YS) of said total area is contributed by integrating areas for inter-particle spacings (AG).

34. The light-extraction apparatus for an optical-film lighting set having a visible-light coating according to claim 33, wherein ranges for said X1 and said YS are formed as a pair selected from one of combinations: (99%>X1≥90%, 0%≤YS<10%), (90%>X1≥80%, 10%≤YS<20%), (80%>X1≥70%, 20%≤YS<30%), (70%>X1≥60%, 30%≤YS<40%), (60%>X1≥50%, 40%≤YS<50%), (50%>X1≥40%, 50%≤YS<60%), (40%>X1≥30%, 60%≤YS<70%), (30%>X1≥20%, 70%≤YS<80%), and (20%>X1≥1%, 80%≤YS<99%).

35. The light-extraction apparatus for an optical-film lighting set having a visible-light coating according to claim 13, further including a discharge gas being filled between said shell body and said at least one supporting member.

36. The light-extraction apparatus for an optical-film lighting set having a visible-light coating according to claim 13, further including a discharge gas being filled inside said at least one supporting member.

37. The light-extraction apparatus for an optical-film lighting set having a visible-light coating according to claim 36, wherein said at least one supporting member is formed to be one of a sphere and a tube.

38. The light-extraction apparatus for an optical-film lighting set having a visible-light coating according to claim 13, further including at least one auxiliary supporting member mounted between said shell body and said at least one supporting member.

39. The light-extraction apparatus for an optical-film lighting set having a visible-light coating according to claim 38, wherein said visible light layer is coated to one surface of said at least one auxiliary supporting member, and the optical film is coated to one of an interior wall and an exterior wall of said shell body.

40. The light-extraction apparatus for an optical-film lighting set having a visible-light coating according to claim 38, wherein said at least one auxiliary supporting member is formed as one of a plate and a board.

41. The light-extraction apparatus for an optical-film lighting set having a visible-light coating according to claim 38, wherein a surface of said at least one auxiliary supporting member includes a coated area (AAS) coated by said visible light layer and the rest of the surface other than the coated area (AAS) is defined as an uncoated area (BAS), wherein the coated area (AAS) occupies 1%~99% of the surface.

42. The light-extraction apparatus for an optical-film lighting set having a visible-light coating according to claim 41, wherein said one of fluorescent particles and phosphorescent particles in said coated area (AAS) are coated in a scattering manner.

43. The light-extraction apparatus for an optical-film lighting set having a visible-light coating according to claim 42, wherein said one of fluorescent particles and phosphorescent particles in said scattering manner are arranged in a form of monolayer coating and have granular sizes ranged from 1 μm to 100 μm.

44. The light-extraction apparatus for an optical-film lighting set having a visible-light coating according to claim 41, wherein 1%~99% of a total area of said coated area (AAS) is an integrated area (X2) of the granular coverage (AAB) of said one of fluorescent particles and phosphorescent particles of said visible light layer, and the rest (YAS) of said total area is contributed by integrating areas for inter-particle spacings (AAG).

45. The light-extraction apparatus for an optical-film lighting set having a visible-light coating according to claim 44, wherein ranges for said X2 and said YAS are formed as a pair selected from one of combinations: (99%>X2≥90%, 0≤YAS<10%), (90%>X2≥80%, 10≤% YAS<20%), (80%>X2≥70%, 20%≤YAS<30%), (70%>X2≥60%, 30%≤YAS<40%), (60%>X2≥50%, 40%≤YAS<50%), (50%>X2≥40%, 50%≤YAS<60%), (40%>X2≥30%, 60%≤YAS<70%), (30%>X2≥20%, 70%≤YAS<80%), and (20%>X2≥1%, 80%≤YAS<99%).

46. A light-extraction apparatus for an optical-film lighting set having a visible-light coating, comprising:

a shell body;

an optical film coated on the shell body;

a visible light layer, consisted of one of fluorescent particles and phosphorescent particles, the one of fluorescent particles and phosphorescent particles being coated inside the shell body in a predetermined scattering manner;

a plurality of supporting members, mounted inside the shell body, and an ultraviolet light source for emitting, in an electroluminescence way, ultraviolet lights having a wave-length combination selected from the group of a pair of (one of 253.7 nm±2 nm and 253.7 nm±2 nm, and 184.9 nm±2 nm) and another pair of (one of 147 nm±2 nm and 147 nm±2 nm, and 173 nm±2 nm).

47. The light-extraction apparatus for an optical-film lighting set having a visible-light coating according to claim 46, wherein said optical film is coated onto an interior wall of said shell body.

48. The light-extraction apparatus for an optical-film lighting set having a visible-light coating according to claim 46, wherein said optical film is characterized in a wide angle of incidence to reflect at least one specific ultraviolet light but to allow visible lights to penetrate therethrough, the wide angle of incident being ranged from 0~90 degrees or from 0~30+ degrees to 90 degrees of reflective angles.

49. The light-extraction apparatus for an optical-film lighting set having a visible-light coating according to claim 46, wherein a material of said optical film is selected from one of AlF3, Al2O3, BaF2, BeO, BiF3, CaF2, DyF2, GdF3, HfO2, HoF3, LaF3, La2O3, LiF, MgF2, MgO, NaF, Na3AlF6, Na5Al3F14, NdF3, PbF2, ScF2, Si3N4, SiO2, SrF2, ThF4, ThO2, YF3, Y2O3, YbF3, Yb2O3, ZrO2, ZrO3, and a combination of ZrO2 and ZrO3.

50. The light-extraction apparatus for an optical-film lighting set having a visible-light coating according to claim 46, wherein each one of said a plurality of supporting members is formed as one of a board, a plate, a tube and a sphere.

51. The light-extraction apparatus for an optical-film lighting set having a visible-light coating according to claim 50, wherein said optical film is coated onto said a plurality of supporting members and each one of said a plurality of supporting members is formed as one of the board and the plate.

52. The light-extraction apparatus for an optical-film lighting set having a visible-light coating according to claim 46, wherein a surface of said a plurality of supporting members includes a coated area (AS) coated by said visible light layer and the rest of the surface other than the coated area (AS) is defined as an uncoated area (BS), wherein the coated area (AS) occupies 1%~99% of the surface.

53. The light-extraction apparatus for an optical-film lighting set having a visible-light coating according to claim 52, wherein said one of fluorescent particles and phosphorescent particles in said coated area (AS) are coated in a scattering manner.

54. The light-extraction apparatus for an optical-film lighting set having a visible-light coating according to claim 53, wherein said one of fluorescent particles and phosphorescent particles in said scattering manner are arranged in a form of monolayer coating and have granular sizes ranged from 1 μm to 100 μm.

55. The light-extraction apparatus for an optical-film lighting set having a visible-light coating according to claim 52, wherein 1%~99% of a total area of said coated area (AS) is an integrated area (X1) of the granular coverage (AB) of said one of fluorescent particles and phosphorescent particles of said visible light layer, and the rest (YS) of said total area is contributed by integrating areas for inter-particle spacings (AG).

56. The light-extraction apparatus for an optical-film lighting set having a visible-light coating according to claim 55, wherein ranges for said X1 and said YS are formed as a pair selected from one of combinations: (99%>X1≥90%, 0%≤YS<10%), (90%>X1≥80%, 10%≤YS<20%), (80%>X1≥70%, 20%≤YS<30%), (70%>X1≥60%, 30%≤YS<40%), (60%>X1≥50%, 40%≤YS<50%), (50%>X1≥40%, 50%≤YS<60%), (40%>X1≥30%, 60%≤YS<70%), (30%>X1≥20%, 70%≤YS<80%), and (20%>X1≥1%, 80%≤YS<99%).

57. The light-extraction apparatus for an optical-film lighting set having a visible-light coating according to claim 50, wherein said a plurality of supporting members further includes an ultraviolet light generator located thereinside, and each of said a plurality of supporting members is formed as one of a tube and a sphere.

58. The light-extraction apparatus for an optical-film lighting set having a visible-light coating according to claim 46, wherein said shell body is mounted inside a reflective dome having an interior dome surface coated with a reflective layer.

59. The light-extraction apparatus for an optical-film lighting set having a visible-light coating according to claim 58, wherein said reflective layer is one of a dielectric reflective membrane and a silver-aluminum film, and said reflective dome is formed to have a volume larger than a hemisphere (i.e. having a maximum depth larger than a radius of the hemisphere).

* * * * *